US006499406B2

(12) United States Patent
Shim

(10) Patent No.: US 6,499,406 B2
(45) Date of Patent: Dec. 31, 2002

(54) BLASTING APPARATUS FOR FORMING HORIZONTAL UNDERGROUND CAVITIES AND BLASTING METHOD USING THE SAME

(76) Inventor: Dong Soo Shim, 1019-1406 Mockdong Apt., Shinjeong-1 dong, Yangcheon-gu, Seoul 158-050 (KR)

( * ) Notice: Subject to any disclaimer, the term of this patent is extended or adjusted under 35 U.S.C. 154(b) by 9 days.

(21) Appl. No.: 09/907,131

(22) Filed: Jul. 17, 2001

(65) Prior Publication Data

US 2002/0083860 A1 Jul. 4, 2002

(30) Foreign Application Priority Data

Dec. 30, 2000 (KR) ..... 2000-86764
Dec. 30, 2000 (KR) ..... 2000-86765

(51) Int. Cl.[7] ..... F42B 1/02; F42D 3/00

(52) U.S. Cl. ..... 102/306; 102/307; 102/310; 102/312; 102/313

(58) Field of Search ..... 102/306, 307, 102/312, 313, 310

(56) References Cited

U.S. PATENT DOCUMENTS

| | | | | |
|---|---|---|---|---|
| 3,013,491 A | | 12/1961 | Poulter | 102/20 |
| 4,135,450 A | | 1/1979 | Lang | 102/23 |
| 4,656,944 A | * | 4/1987 | Gonzales | 102/312 |
| 4,776,638 A | | 10/1988 | Hahn | 299/5 |
| 5,000,261 A | | 3/1991 | Fitzgibbon, Jr. | 166/187 |
| 5,253,585 A | * | 10/1993 | Hudak et al. | 102/311 |
| 5,355,802 A | | 10/1994 | Petitjean | 102/313 |
| 5,648,635 A | | 7/1997 | Lussier et al. | 102/307 |
| 5,777,257 A | | 7/1998 | Kenny | 102/312 |
| 6,006,833 A | | 12/1999 | Burleson et al. | 166/250.08 |
| 6,142,229 A | | 11/2000 | Branson, Jr. et al. | 166/250.15 |
| 6,148,730 A | * | 11/2000 | Watson | 102/312 |
| 6,286,430 B1 | | 9/2001 | Salort | 102/378 |

FOREIGN PATENT DOCUMENTS

| | | |
|---|---|---|
| WO | WO 96/13698 | 5/1996 |
| WO | WO 96/29567 | 9/1996 |

* cited by examiner

*Primary Examiner*—Peter A. Nelson
(74) *Attorney, Agent, or Firm*—Sheridan Ross P.C.

(57) ABSTRACT

Disclosed herein is a blasting apparatus for forming horizontal underground cavities and blasting method using the same. The blasting apparatus includes a metallic body horizontally formed through the center portion of a loading chamber. A delayed detonator and a shaped explosive are loaded in the loading chamber of the body. A connecting ring is formed on the body for connecting the body to a hoisting rope. The blasting method includes the step of loading a detonator lead, a delayed detonator and a shaped explosive in a loading chamber. The blasting apparatus is suspended over a vertical pit by operating a hoisting device. The blasting apparatus suspended by the hoisting rope is lowered to the entrance of a vertical pit, and a detonator lead drawn out of the body is connected to a leading wire. The blasting apparatus and the leading wire connected to the detonator lead drawn out of the body are lowered into the vertical pit at a position where fluid discharges. The shaped explosive loaded in the blasting apparatus positioned at the position where fluid discharges or will discharge is detonated. The body of the blasting apparatus is retrieved by lifting the body using the hoisting device.

23 Claims, 21 Drawing Sheets

- PRIOR ART -

- PRIOR ART -

- PRIOR ART -

BLASTING APPARATUS FOR FORMING HORIZONTAL UNDERGROUND CAVITIES AND BLASTING METHOD USING THE SAME

BACKGROUND OF THE INVENTION

1. Field of the Invention

The present invention relates generally to a blasting apparatus and method for forming horizontal underground cavities to mine underground water, hot spring water, petroleum, natural gas, or the like, and more particularly to a blasting apparatus and method for forming horizontal underground cavities, which is capable of generating directional, continuous and concentrated explosive power by positioning and exploding the blasting apparatus at a position where fluid discharges or will discharge, thereby forming horizontal underground cavities by creating conical openings and enlarging fluid discharge passages.

2. Description of the Prior Art

While underground water, hot spring water, petroleum and gas flows out of a fluid layer such as an aquifer, an oil layer or a gas layer for a long time, detritus such as rubble, clay and/or dregs is accumulated in a portion of a fluid discharge passage through which the fluid discharges, so the amount of fluid discharged through the fluid discharge passage is decreased or, what is worse, the fluid discharge is fully blocked.

Accordingly, in order to increase the amount of fluid flowing out of a fluid layer, such as an aquifer, an oil layer or a gas layer, the following two prior arts have been proposed. A first prior art is to drill a new pit so as to mine fluid. A second prior art is to situate and explode an explosive at a position near a fluid discharge passage so as to open the partially or fully blocked fluid discharge passage by the explosive power of the explosive.

However, for the first prior art, the costs of a pit drilling operation and the costs of the removal and reinstallation of old facilities are additionally required, so it is not desirable from an economic point of view. For the second prior art, the explosive power of the explosive is scattered, so the explosive power cannot be concentrated to be sufficient to form horizontal underground cavities and may collapse the wall of the vertical pit H.

In order to open the existing fluid discharge passages, there has been utilized a blast method, in which an explosive 1 provided with a delayed detonator 2 is connected by an explosive tie 4 to a ring 5 connected to a hoisting chain 6, lowered to a position in a vertical pit H beside the existing fluid discharge passages P, and exploded at the position, as shown in FIGS. 1*a* to 1*c*.

Such a type of explosion is conducted while an explosive is exposed to the outside, like an explosion in a hole, water or air. Hereinafter, this type of explosion is referred to as "an open-air type explosion".

In the open-air type explosion, since the explosive is exploded while being suspended in the vertical pit H, the explosive power of the explosive, as illustrated in FIG. 1*b*, is scattered over the vertical pit H. As a result, the loss of the explosive power is great and the explosive power is not concentrated, so the explosive power is not exerted on the desired area of the wall of the vertical pit H, thereby creating an incorrect blasting result.

Additionally, as illustrated in FIG. 1*c*, in the case of an explosion in a vertical hole, the range of the explosion is excessively wide, so great pressure is exerted upon the large area of the wall of the vertical hole. Accordingly, the wall of the vertical hole is damaged or broken, so the wall of the vertical hole is deformed or completely collapsed. As a result, the vertical hole becomes useless and an outflow passage is not newly created or not opened. That is, the conventional blasting technique is not desirable.

That is, in the open-air type explosion, since the explosive is positioned and exploded in the vertical pit H, the explosive power of the explosive is scattered through the open upper and lower portions of the vertical pit H, resulting in the loss of the explosive power and, therefore, the hindrance of the concentration of the explosive power.

For the opening of a blocked fluid discharge passage, the explosive power of the explosive should be exerted on the blocked portion of the fluid discharge passage. However, since the explosive power of the explosive is scattered, the explosive power cannot reach the blocked portion of the fluid discharge passage to open the blocked fluid discharge passage and, rather, collapses or damages the wall of the vertical pit H, thereby hindering the effective blasting of the horizontal cavities.

The conventional blasting operation is restricted to one time blasting in which the blasting apparatus is inserted into and exploded in the vertical pit H. In particular, since underground water in the vertical pit H serves as an obstacle, the blasting effect of the explosive is decreased due to the pressure of underground water, and the lowering speed of the explosive into the vertical pit is reduced due to the buoyancy of the underground water, thereby decreasing the efficiency of the blasting operation.

In addition, the instability of an explosion, such as a misexplosion, a half explosion or the like, is created due to water pressure, the explosion effect of a shaped explosive cannot be utilized because of the open-air type explosion, and the explosive is difficult to handle safely due to problems such as the contact of the explosive with the wall of the vertical pit H.

The inventor of the present invention proposes "a closed type explosion" that is capable of obtaining directional, concentrated and continuous explosive power. In the closed type explosion, an explosive is exploded in a sealed explosion space that is separated from the surroundings.

To this end, there is provided a blasting apparatus for forming horizontal underground cavities. In the blasting apparatus of the present invention, a loading chamber is horizontally formed through the center portion of a metallic body and a shaped explosive and a delayed detonator are loaded in the loading chamber so as to allow the explosive power of the shaped explosive to be concentrated and exerted in a horizontal direction.

Additionally, there is provided a blasting method using the blasting apparatus for forming horizontal underground cavities, in which the blasting apparatus is situated and exploded one or many times at a position where fluid discharges or will discharge, thereby forming conical openings and enlarging fluid discharge passages.

SUMMARY OF THE INVENTION

Accordingly, the present invention has been made keeping in mind the above problems occurring in the prior art, and an object of the present invention is to provide a blasting apparatus for forming horizontal underground cavities and method using the same, which is capable of directing explosive power in a horizontal direction by exploding a shaped explosive in a restricted, horizontal loading chamber, so the explosive power of the shaped explosive is concentrated in the direction perpendicular to the direction of a vertical pit and the explosive power is continued, thereby forming horizontal underground cavities without the collapse of the wall of the vertical pit by exerting explosive power on the desired area of the wall of the vertical pit.

Another object of the present invention is to provide a blasting apparatus for forming horizontal underground cavities and method using the same, which is capable of enlarging a fluid discharge passage and reopening a blocked fluid discharge passage without requiring a new pit drilling operation to regenerate an existing pit when the amount of fluid is reduced or a fluid discharge passage is blocked while fluid is mined from an underground water pit, a hot spring pit, a natural gas pit or a petroleum pit, thereby saving the costs of a new pit drilling operation and the costs of the removal and reinstallation of facilities and improving the economic efficiency of a underground cavity blasting operation.

A further object of the present invention is to provide a blasting apparatus for forming horizontal underground cavities and method using the same, which is capable of generating directional explosive power, being repeatedly exploded and being circumferentially exploded when an underground water pit, a hot spring pit, a natural gas pit or a petroleum pit is developed, so the probability of success of an underground cavity forming operation is maximized.

A still further object of the present invention is to provide a blasting apparatus for forming horizontal underground cavities and method using the same, which obviates the need for excessive pit drilling operations that are carried out to mine underground water, petroleum or gas, so underground pollution through the drilled pits can be prevented, thereby contributing to environmental conservation.

In order to accomplish the above object, the present invention provides a blasting apparatus for forming horizontal underground cavities, comprising: a metallic body horizontally formed through a center portion of a loading chamber; a delayed detonator and a shaped explosive loaded in the loading chamber of the body; and a connecting ring formed on the body for connecting the body to a hoisting rope.

The blasting apparatus may further comprise two pipe-shaped gaps formed in the body around the loading chamber, the two pipe-shaped gaps being coaxial with the loading chamber and each having a diameter larger than the loading chamber; two delayed detonators and two propulsive explosives loaded in the pipe-shaped gaps; and two plastic sealing pipes for stopping up the pipe-shaped gaps after the delayed detonators and the propulsive explosives are loaded in the pipe-shaped gaps.

The body may be formed in the shape of an egg so as to reduce friction between the body and fluid filling a vertical pit while the body is lowered through the vertical pit.

The body may have a width in the range of 80 to 90% of the diameter of the vertical pit.

The apparatus may further comprise a through hole for a detonator lead, the through hole being extended from the upper surface of the body to the center portion of the loading chamber.

The apparatus may further comprise one or more through holes for one or more detonator leads, the through holes being extended from the upper surface of the body to the center portion of the pipe-shaped gaps.

The body may have a weight in the range of 50 to 500 kg.

The shaped explosive may be provided at both ends with cone-shaped recesses.

The apparatus may further comprise two funnel-shaped lines, the liners being attached to the cone-shaped recesses, respectively.

The shaped explosive may have the amount of loading in the range of 0.1 to 1 kg.

The apparatus may further comprise two covers, the covers being attached to stepped portions of the entrances of the loading chamber loaded with the shaped explosive.

The connecting chain may comprise a plurality of rings to prevent the connecting chain from being twisted.

In addition, the present invention provides a blasting apparatus assembly for forming horizontal cavities, comprising a plurality of metallic bodies each horizontally provided with a loading chamber; a plurality of delayed detonators and a plurality of explosives loaded in the loading chambers of the bodies; and a plurality of connecting chains each connecting one body to another.

The blasting apparatus may each further comprise two pipe-shaped gaps formed in the body around the loading chamber, the two pipe-shaped gaps being coaxial with the loading chamber and each having a diameter larger than the loading chamber; two delayed detonators and two propulsive explosives loaded in the pipe-shaped gaps; and two plastic sealing pipes for stopping up the pipe-shaped gaps after the delayed detonators and the propulsive explosives are loaded in the pipe-shaped gaps.

The blasting apparatuses connected to one another by the connecting chains may have the loading chambers with each of loading chambers of one blasting assembly arranged in the same direction as a corresponding loading chamber of another blasting assembly.

The blasting apparatuses connected to one another by the connecting chains may have the loading chambers with each of loading chambers of one blasting apparatus arranged to be perpendicular to a corresponding loading chamber of a neighboring blasting apparatus.

In addition, the present invention provides a blasting method for forming horizontal cavities, comprising the steps of loading a detonator lead, a delayed detonator and a shaped explosive in a loading chamber horizontally formed through a center portion of a body of a blasting apparatus; suspending the blasting apparatus over a vertical pit by operating a hoisting device after a connecting ring of a body of the blasting apparatus is connected to a hoisting rope by a connecting chain; lowering the blasting apparatus suspended by the hoisting rope to an entrance of a vertical pit, and connecting a detonator lead drawn out of the body to a leading wire wound around a take-up device positioned on a support surface just before the blasting apparatus enters the vertical pit; lowering the blasting apparatus and the leading wire connected to the detonator lead drawn out of the body into the vertical pit at a position where fluid discharges; detonating the shaped explosive loaded in the blasting apparatus positioned at the position where fluid discharges or will discharge; and retrieving the body of the blasting apparatus by lifting the body using the hoisting device.

The explosive detonating step may comprise the steps of firstly detonating delayed detonators and propulsive explosives loaded in two pipe-shaped gaps, which are coaxial with the loading chamber and have a diameter larger than the loading chamber, so as to bring two sealing pipes into contact a with the wall of the vertical pit and seal a detonating space from the outside; and secondly detonating the shaped explosive loaded in the loading chamber.

The blasting apparatuses may have the loading chambers with each of loading chambers of one blasting assembly arranged in the same direction as a corresponding loading chamber of another blasting assembly, and the blasting apparatuses may be sequentially lowered to and repeatedly exploded at an explosion position to repeatedly blast the position.

The blasting apparatuses may have the loading chambers with each of loading chambers of one blasting apparatus arranged to be perpendicular to a corresponding loading chamber of a neighboring blasting apparatus, and the blasting apparatuses may be sequentially lowered to and repeatedly exploded at an explosion position to circumferentially blast horizontal cavities.

The detonating step may be performed by a remote controller.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

First of all, the principles of the present invention are described.

In order to form horizontal cavities in the wall of a vertical pit, it is essential to concentrate the explosive power of the shaped explosive in a horizontal direction. In the meantime, even though any mechanical machine, such as a drilling machine, is employed to form holes, it is difficult to drill horizontal cavities in the wall of a pit having a depth of several tens or several thousands meters.

In the same manner as when a rifle is fired, a bullet is advanced through the barrel of the rifle toward a target, a loading chamber is horizontally formed through the center portion of the body and a shaped explosive is loaded and exploded in the loading chamber. As a result, the shaped explosive is exploded in a closed type explosion, so the explosive power of the shaped explosive is discharged in a horizontal direction, thereby forming horizontal underground cavities and enlarging fluid discharge passages.

In addition, the explosive power of the shaped explosive is centrally concentrated by the Neumann effect, which is the effect caused by a shaped explosive and is applied to an antitank high explosive, so as to exert concentrated pressure on the desired portions of a vertical pit. Additionally, there is employed sealing pipes that are brought into contact with the wall of a pit when the explosive is detonated so as to seal an explosive space, so powerful and concentrated explosive power can be generated for a certain period of time in a certain direction without loss of power.

That is, the blasting apparatus and method of the present invention is a technique in which a blasting apparatus loaded in its loading chamber with a shaped explosive is situated in a pit at a position where fluid discharges or may discharge and the explosive power of the shaped explosive is exerted in a horizontal direction to form horizontal cavities in the wall of the pit.

A blasting apparatus for forming horizontal underground cavities in accordance with the present invention is described in detail with reference to accompanying drawings.

Figure 1A:
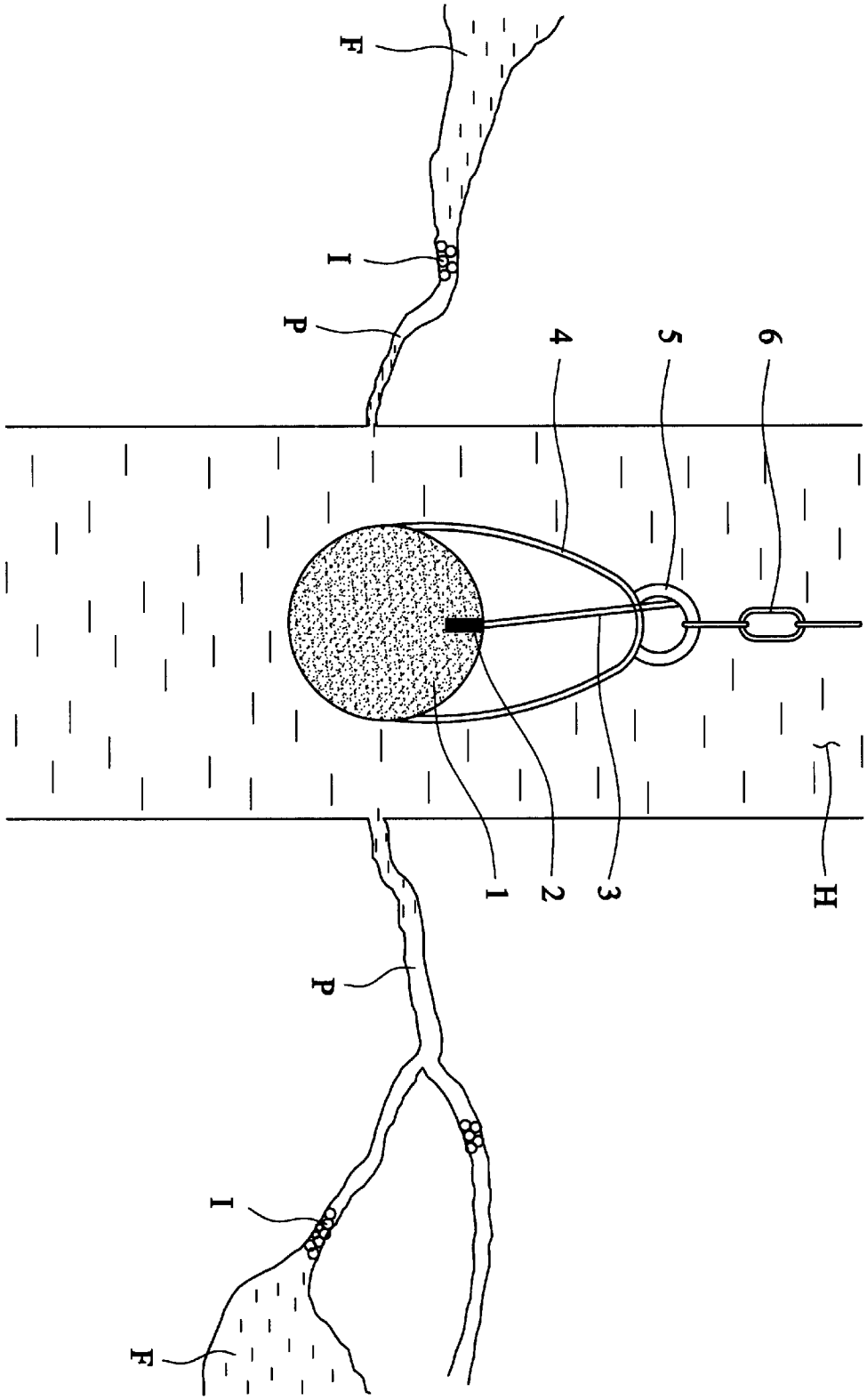
FIG. 1*a* is a view showing a conventional blasting apparatus situated in a vertical pit.
Figure 1B:
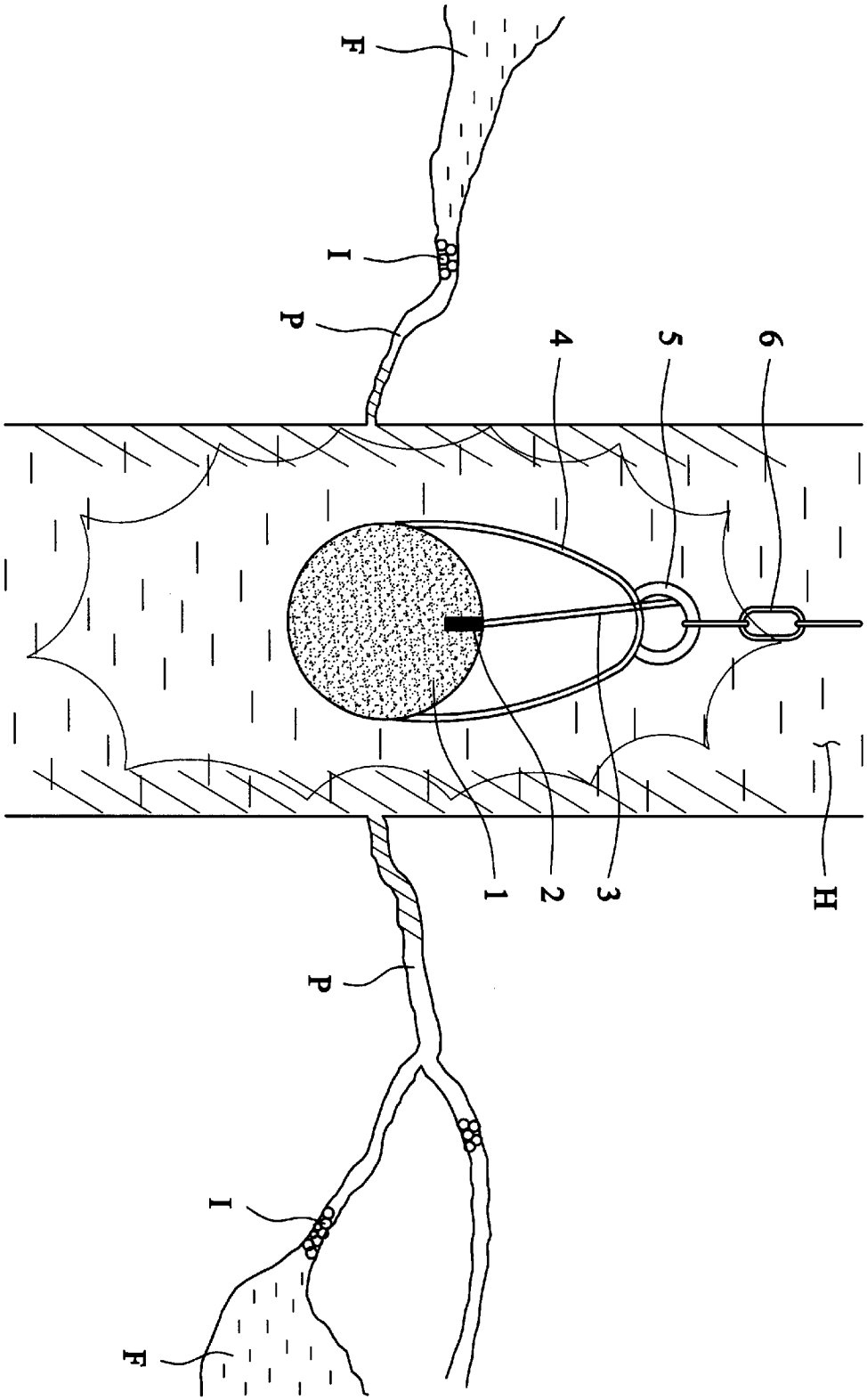
FIG. 1*b,* is a view showing the operation of the conventional blasting apparatus.
Figure 1C:
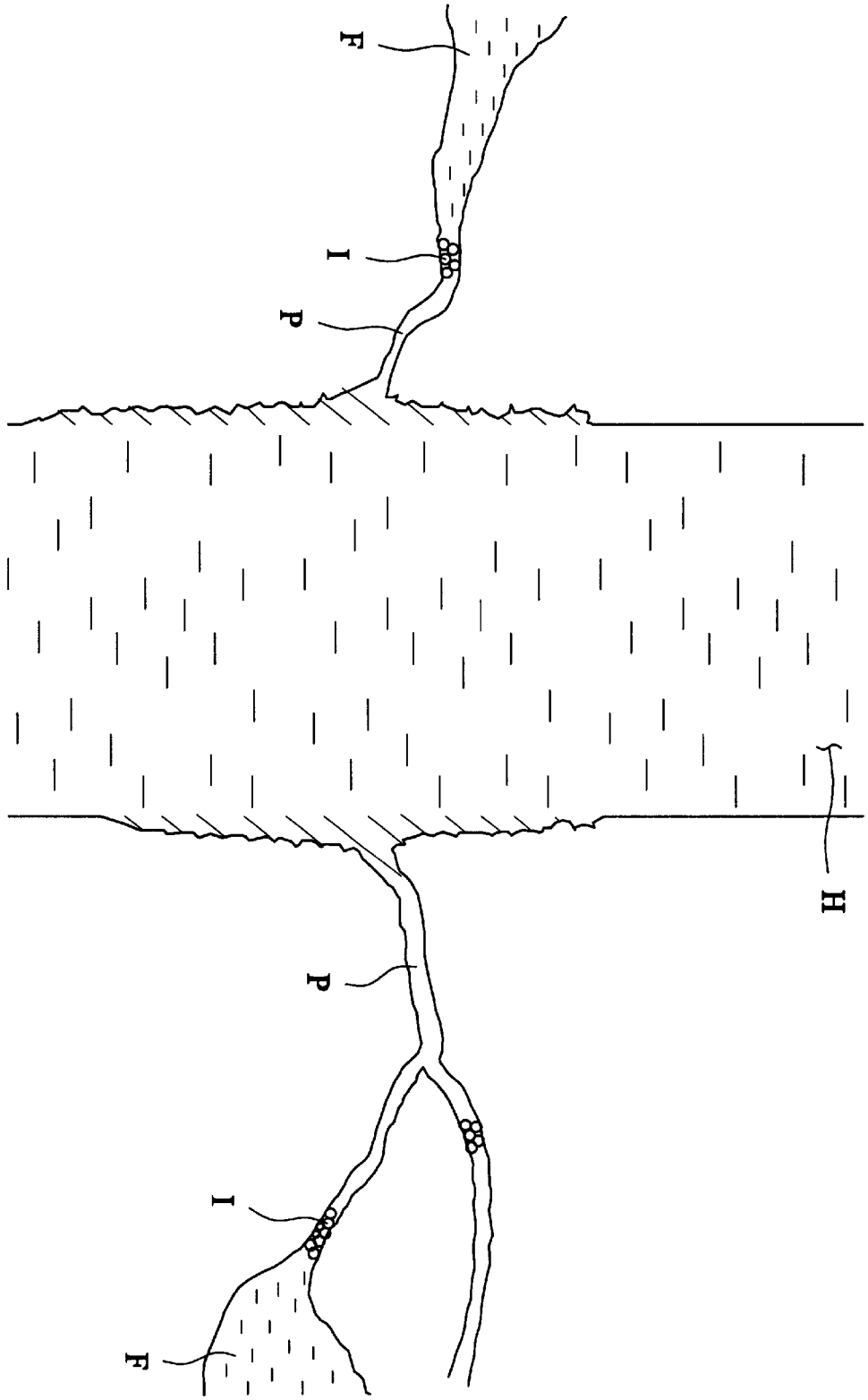
FIG. 1*c* a view showing the blasted portion of the vertical pit after the conventional blasting apparatus is exploded.
Figure 2A:
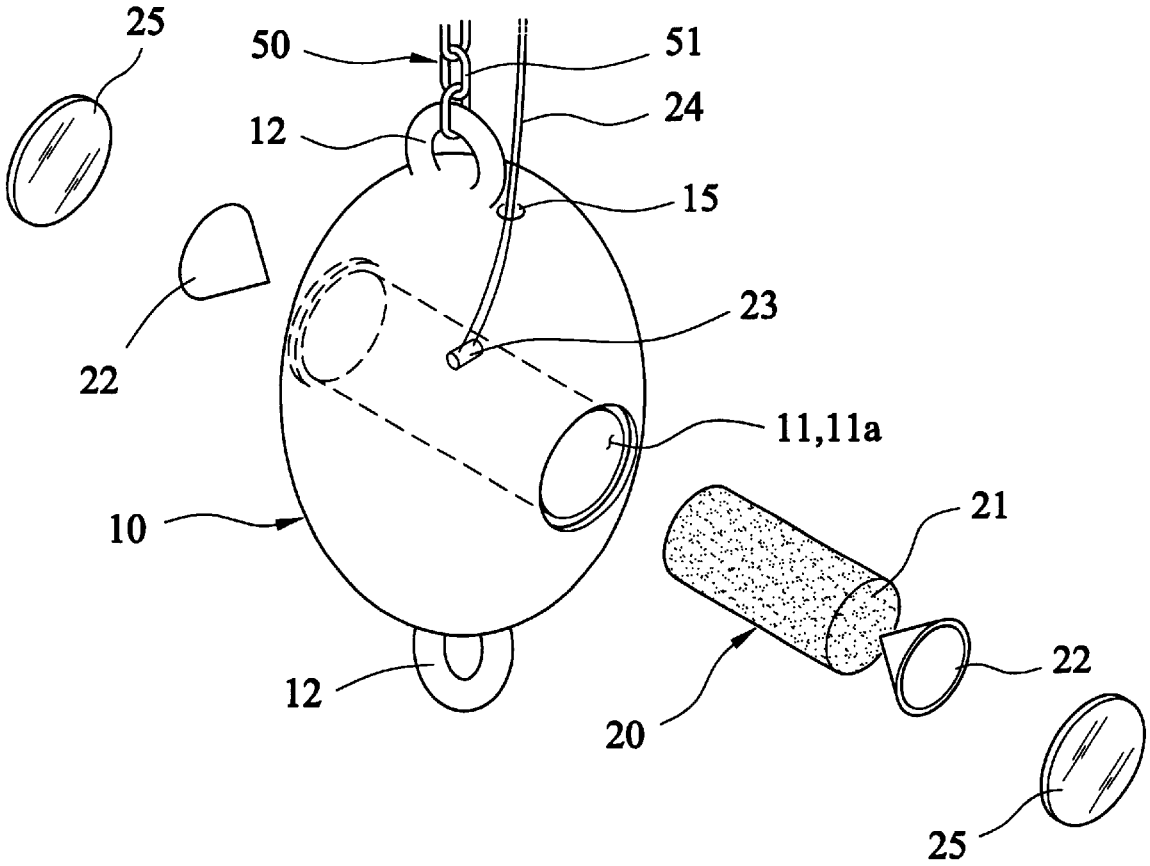
FIG. 2*a* is an exploded perspective view showing a blasting apparatus in accordance with a first embodiment of the present invention.
Figure 2B:
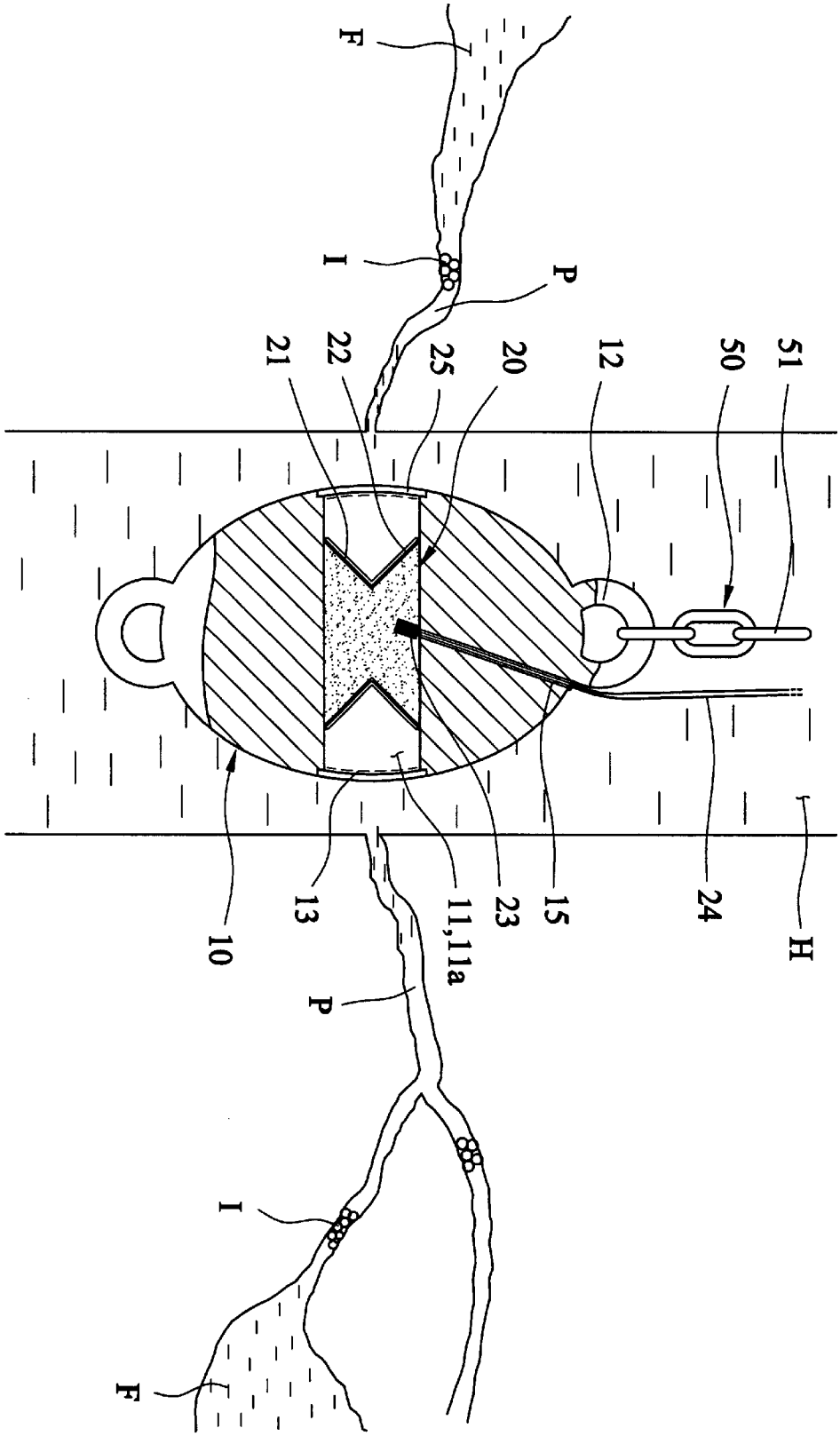
FIG. 2*b* is a view showing the blasting apparatus of the first embodiments situated in a vertical pit.

As shown in FIG. 2*b,* a through hole 11*a* having a certain diameter is horizontally formed through the center portion of the body 10. Two connecting rings 12 are formed to allow the body 10 to be hoisted by a hoisting rope. In order to increase the loading speed of an explosive, the body 10 preferably has an egg shape. Both sides of the body 10 are protruded, so the sides of the body are situated near the wall of a pit when the blasting apparatus is inserted into the pit H.

Referring to FIG. 2*b,* the reason why the body 10 is an egg shaped is that the blasting apparatus can be prevented from being brought into contact with the wall of a pit H because of the balanced weight of the body 10 and an reduction in the area of the lower end of the body 10, and the body 10 can be rapidly lowered in the pit H because of a reduction in the friction between the body 10 and fluid contained in the pit and, therefore, a reduction in the buoyancy of the body 10.

The body 10 can have a cylindrical, conical, hexagonally sectioned or octagonally sectioned shape. However, the egg shape is preferable for the body 10.

Meanwhile, the reason why the body is made of metal having a high strength and to have a certain sectional shape is that the body 10 surrounding the loading chamber 11 is prevented from being fractured while the explosive loaded in the loading chamber 11 is detonated and, therefore, the body 10 is retrieved and used again.

The reason why both sides of the body 10 are protruded to come in contact with the wall of the pit H is that the explosive power of the explosive loaded in the loading chamber 11 is exerted on the wall of the pit H at close range and the area where explosive power is exerted is limited to concentrate the explosive power of the shaped explosive projected from the loading chamber of the blasting apparatus.

In the meantime, the width of the body 10 is determined depending on the size of the vertical pit H. In general, the width of the body 10 is about 80 to 90% of the diameter of the vertical pit H. The reason for this is that the body 10 can be easily inserted into the vertical pit H when the width of the body 10 is smaller than the diameter of the vertical pit H.

For example, a vertical pit, which is bored to mine underground water, petroleum or gas, generally has a diameter in the range of 100 to 2,000 mm, so the body 10 is made to have a width in the range of 80 to 1,800 mm so as to allow the body 10 to be easily inserted into this vertical pit. The weight of the body 20 is preferably in the range of 50 to 500 kg, and the diameter of the loading chamber 11 is in the range of 50 to 250 mm.

The loading chamber 11 is comprised of the through hole 11*a* passing through the center portion of the body 10. The space within the loading chamber 11 serves as a chamber in which the delayed detonator 23 and the shaped explosive 20 are loaded, and two entrances of the loading chamber 11 serve as discharge through which the explosive power of the shaped explosive 20 is discharged. Accordingly, since a directional explosion is made possible, the explosive power can be discharged in a horizontal direction to concentrate the explosive power.

The connecting rings 12 are integrally formed on the upper and lower ends of the body 10. The connecting rings 12 are fusion-welded onto the body 10, and the connecting chains 50 are stuck into the connecting rings 12. Although not illustrated in the accompanying drawings, it is possible that a connecting hole is formed through the upper or lower portion of the body 10 and a connecting chain 50 is stuck into the connecting hole.

Figure 2C:
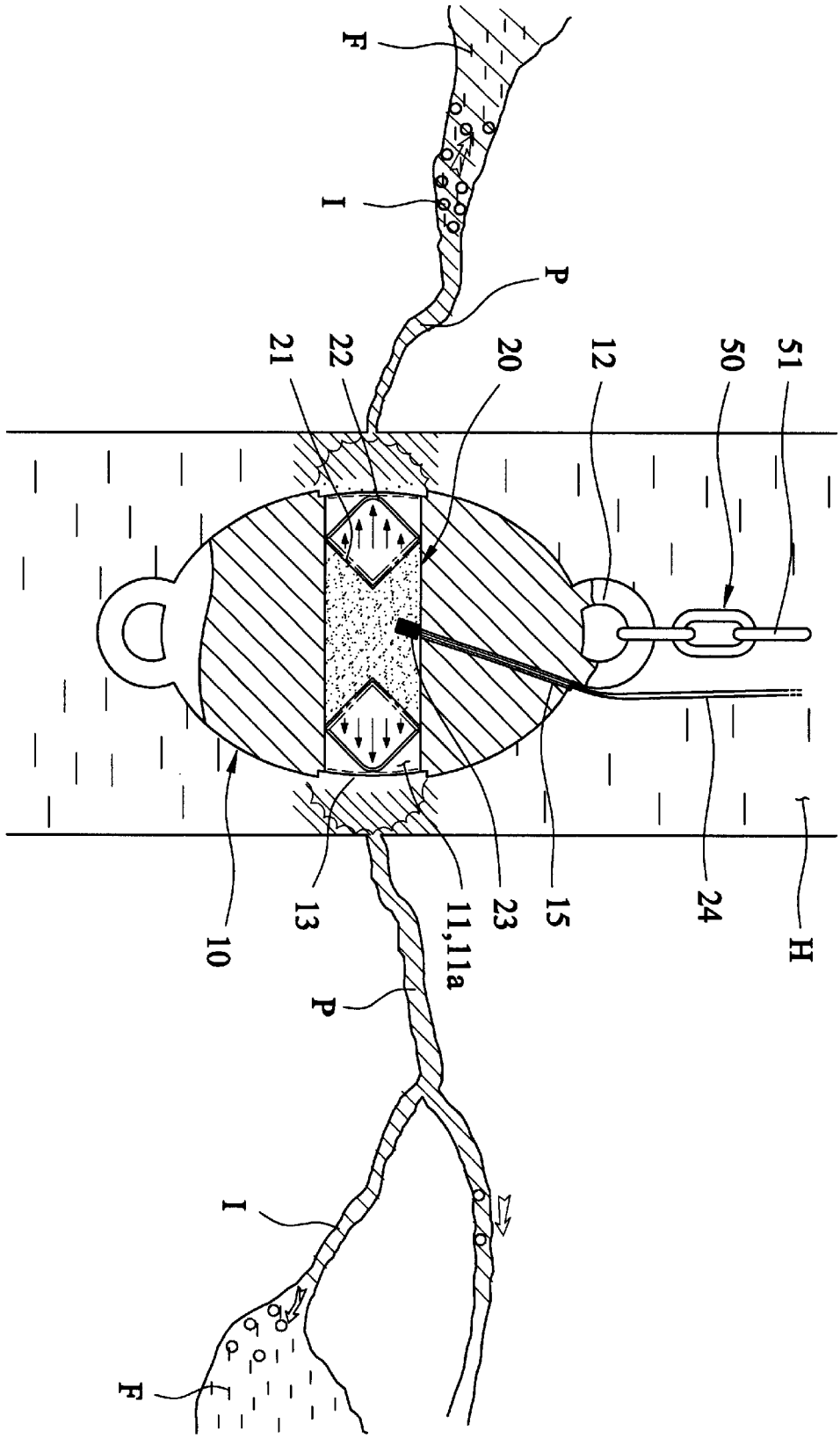
FIG. 2*c* is a view showing the operation of the blasting apparatus of the first embodiment.

As shown in FIGS. 2*b* and 2*c,* a through hole 15 is extended from a position on the upper end portion of the body to the center of the body 10. The detonator lead 24 is drawn through the through hole 15, and connected to the delayed detonator 23 embedded in the shaped explosive 20. Alternatively, the detonator lead 24 can be inserted into the loading chamber 11 through the entrances of the loading chamber 11.

One end of the detonator lead 24 is connected to the delayed detonator 23 and loaded in the loaded chamber 11 along with the delayed detonator 23 and the shaped explosive 20, while the other end of the detonator lead 24 is drawn from the through hole 15 and will be connected to the leading wire just before the blasting apparatus is inserted into the vertical pit H.

Although not illustrated in the accompanying drawings, a cooling unit can be positioned in the body 10 so as to prevent the body 10 from being heated. The cooling unit can be positioned in the body 10 so that an increase in temperature of the body 10 influences the delayed detonator 23 while the body 10 loaded with the shaped explosive 20 and the delayed detonator 23 is lowered deep into the vertical pit H.

The shaped explosive 20, as shown in FIGS. 2*b* and 2*c,* is provided on its both sides with conical recesses 21. Since the shaped explosive 20 should have energy to form horizontal cavities but not to fracture the body 10, the amount of loaded explosive is desired to be in the range of 0.1 to 1 kg.

The reason for this is that the amounts of explosive power and gas pressure become insufficient when the amount of loaded explosive is less than 0.1 kg and the body 10 of the blasting apparatus and the wall of the pit may be fractured when the amount of loaded explosive is more than 1 kg The reason why conical recesses are formed on both sides of the explosive is that the conical recesses allow the explosive power of the shaped explosive to be concentrated toward the centers of the conical recesses, that is, the direction of the vector sum of the explosive forces that is determined by the Neumann effect while the shaped explosive is detonated.

Figure 2D:
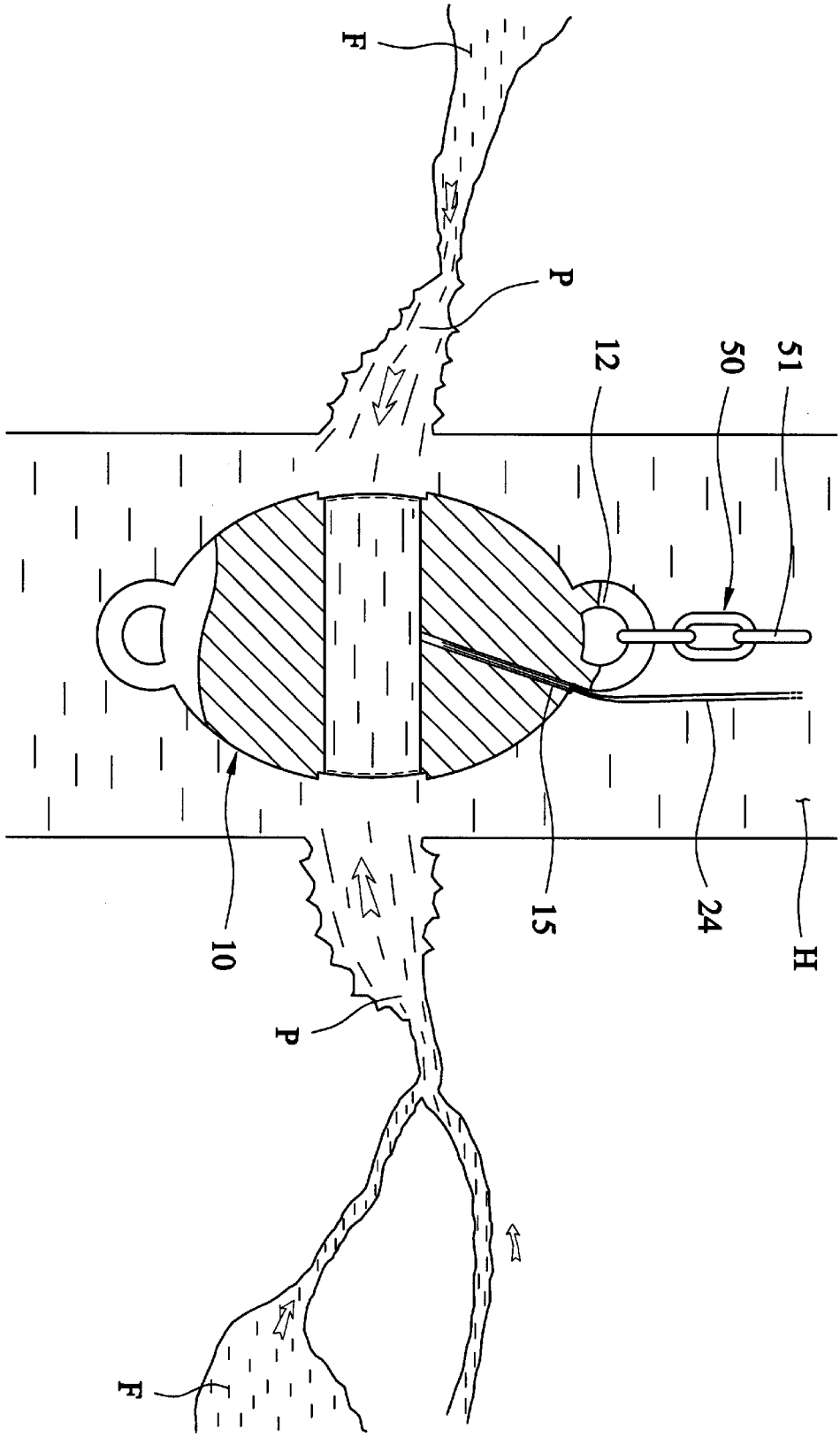
FIG. 2*d* is a view showing the further developed operation of the blasting apparatus of the first embodiment.

Like an antitank high explosive utilizing the Neumann effect and penetrating the armor of a tank (the antitank high explosive can penetrates an armor of 35 cm), the blasting apparatus of the present invention, as shown in FIGS. 2*c* and 2*d,* forms horizontal conical cavities. Accordingly, explosive power penetrates deep into a rock and the joint zone of a rock, so detritus I is removed away from fluid discharge passages P. Additionally, the explosive power forms horizontal cavities by enlarging the discharge passages, so fluid can discharge desirably.

As described above, when the shaped explosive provided with conical recesses 21 is detonated, expected effect can be achieved by the Neumann effect. More preferably, as shown FIGS. 2*a* to 2*c,* the more powerful concentration of explosive power can be achieved by the attachment of liners to the surfaces of the conical recesses 21 formed in the shaped explosive. The liners have conical shapes, are formed of steel or copper, and each are 1 mm in thickness.

Meanwhile, for the delayed detonator 23, an MS delayed detonator or LP delayed detonator is employed. A gap is formed around the detonator lead 24, which is connected to the delayed detonator and drawn from the through hole 15. In order to prevent the blasting apparatus from being misdetonated due to the infiltration of fluid while the body 10 is inserted into the vertical pit H, the gap between the detonator lead 24 and the through hole 15 is sealed.

When the shaped explosive 20 is completely loaded in the loading chamber, two plastic or glass covers 25 are each attached by a bonding agent to the stepped portion formed on the entrance of the loading chamber and seal the loading chamber. This is to prevent the shaped explosive 20 from being affected by the pressure of fluid.

Figure 2E:
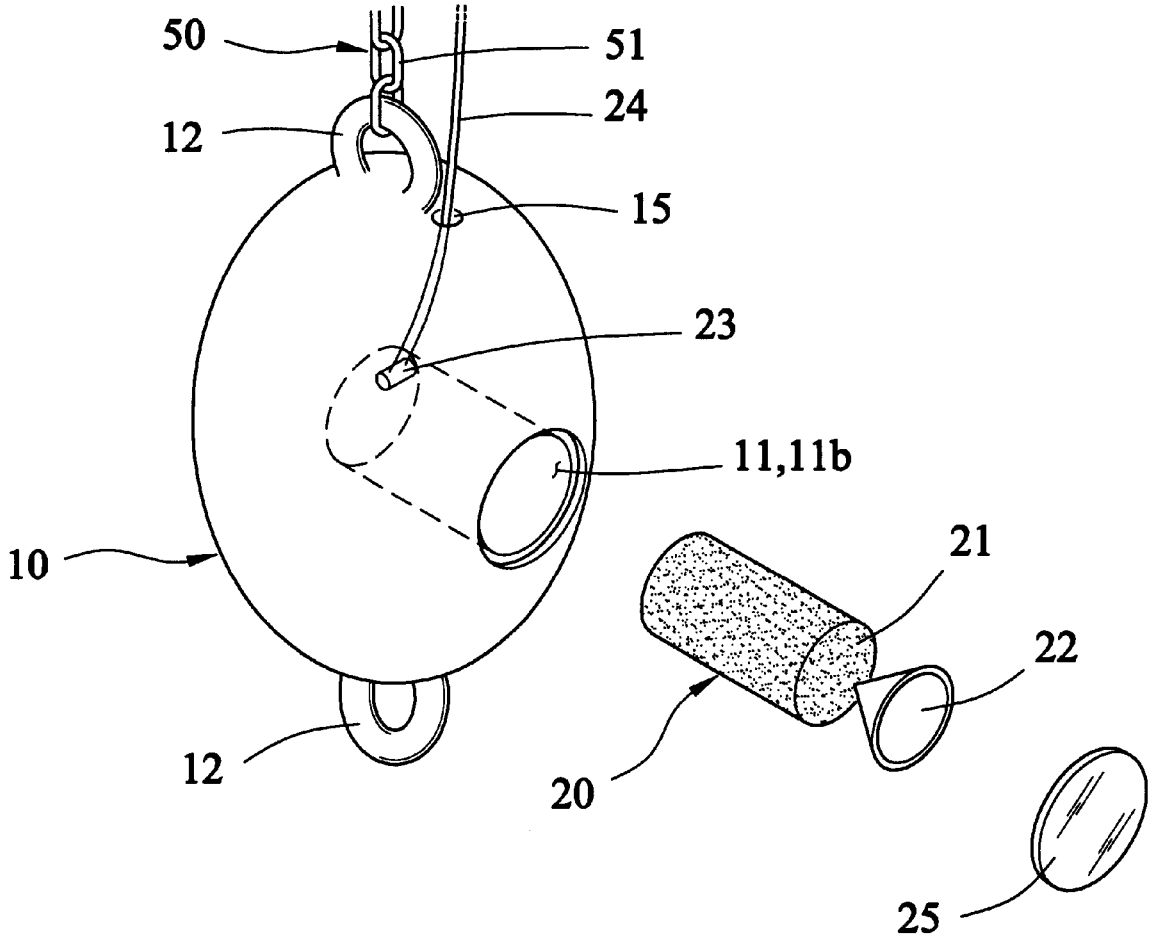
FIG. 2*e* is an exploded perspective view showing a modification of the blasted apparatus of the first embodiment.
Figure 2F:
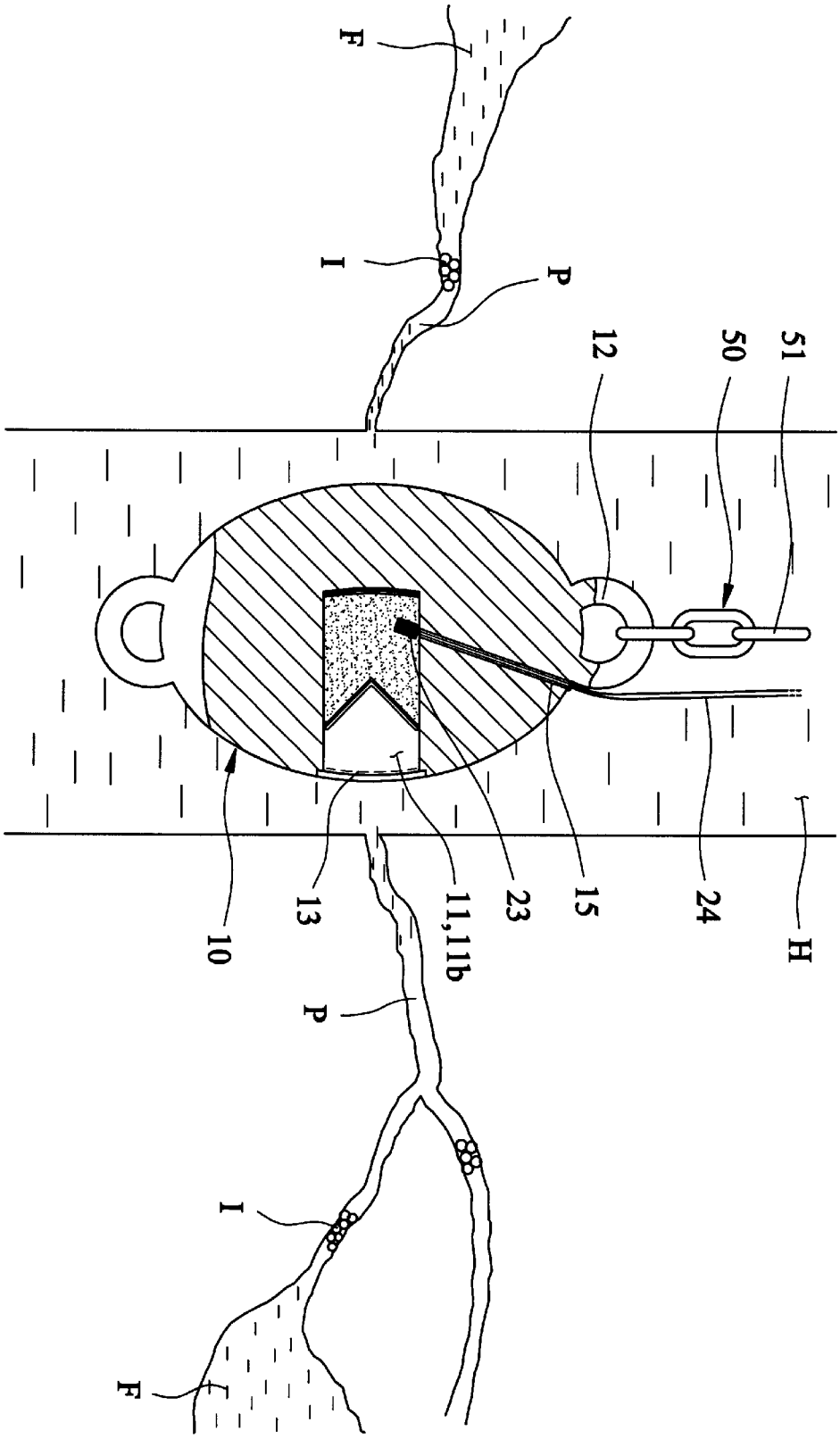
FIG. 2*f* is a view showing the modification of the blasted apparatus of the first embodiment situated in a vertical pit.

The loading chamber 11 formed in the center portion of the body 10 can be a through hole 11*a* as shown in FIG. 2*a,* or an inner end-closed hole 11*b* as shown in FIGS. 2*e* and 2*f.*

In such a case, the thickness of the solid portion situated beside the inner end-closed hole 11*b* is determined in consideration of the strength of the material of the body 10 and the strength of the explosive power of the shaped explosive so as to prevent the body 10 from being fractured.

Unlike the hole 11*b* shown in FIGS. 2*e* and 2*f,* a partition wall 18 is formed on the center portion of the body 10 and a plurality of holes 11*b* are formed to be symmetrical with respect to the partition wall 18. Alternatively, a plurality of holes 11*b* are radially formed, preferably, at intervals of 90°.

In such a case, the partition wall 18 situated in the center portion of the body 10 has a sufficient thickness to prevent the body 10 from being fractured, and the thickness of the partition wall 18 is determined in consideration of the strength of the material of the body 10 and the strength of the explosive power of the shaped explosive.

The holes 11*b* function as loading chambers where the delayed detonator 23 and the shaped explosive 20 are loaded. The entrances of the holes 11*b* function as discharge openings that guide the discharge of the explosive power of the shaped explosives loaded in the holes 11*b*.

Since the delayed detonator 23 and the shaped explosive 20 can be detonated in a sealed state, the explosive power of the shaped explosive 20 has a direction to be discharged in a horizontal direction, thereby allowing the explosive power to be concentrated.

If the blasting apparatus 13 is situated in the vertical pit H at a position where fluid discharges or will discharge and the shaped explosive 20 is detonated, the explosive power becomes directional and, therefore, is concentrated, thus strongly acting on a rock or the joint zone of a rock.

Since the explosive power acts with a direction and concentration, detritus I blocking the discharge passages P are removed to open the discharge passages P. Additionally, the explosive power enlarges the discharge passages P to form horizontal cavities, so fluid can flow smoothly through the discharge passages P.

Figure 3A:
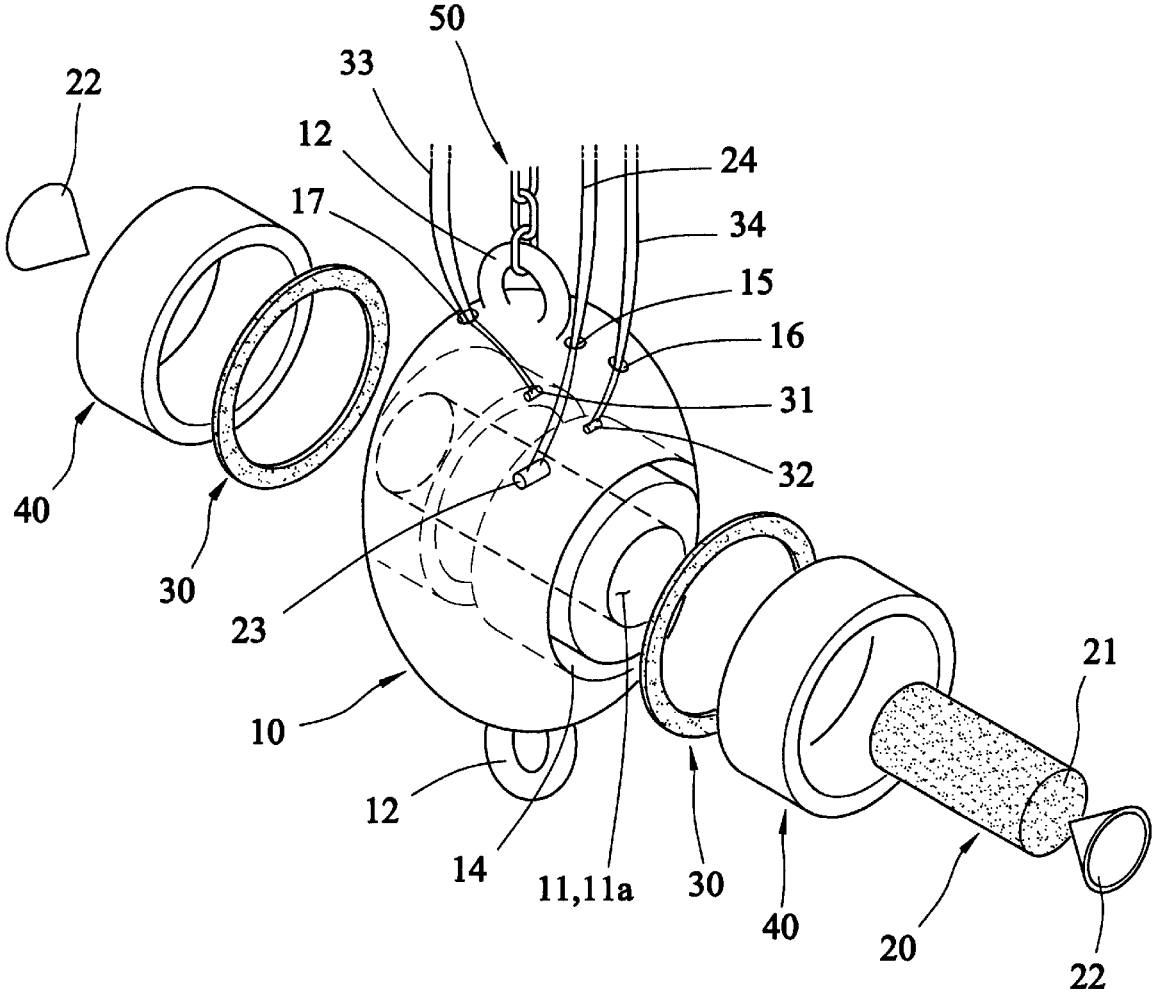
FIG. 3*a* is an exploded perspective view showing a blasting apparatus in accordance with a second embodiment of the present invention.

In the meantime, FIG. 3*a* is a view showing a modification of the body of FIG. 2*a*. As depicted in FIGS. 3*a* to 3*d*, two pipe-shaped gaps 14, which are coaxial with the loading chamber 11 and each have a diameter larger than the loading chamber 11, are formed in the body 10 around the loading chamber 11. Two propulsive explosives 30 each provided with a delayed detonator 31 or 32 and two plastic sealing pipes 40 are each loaded in each pipe-shaped gap 14.

Figure 3B:
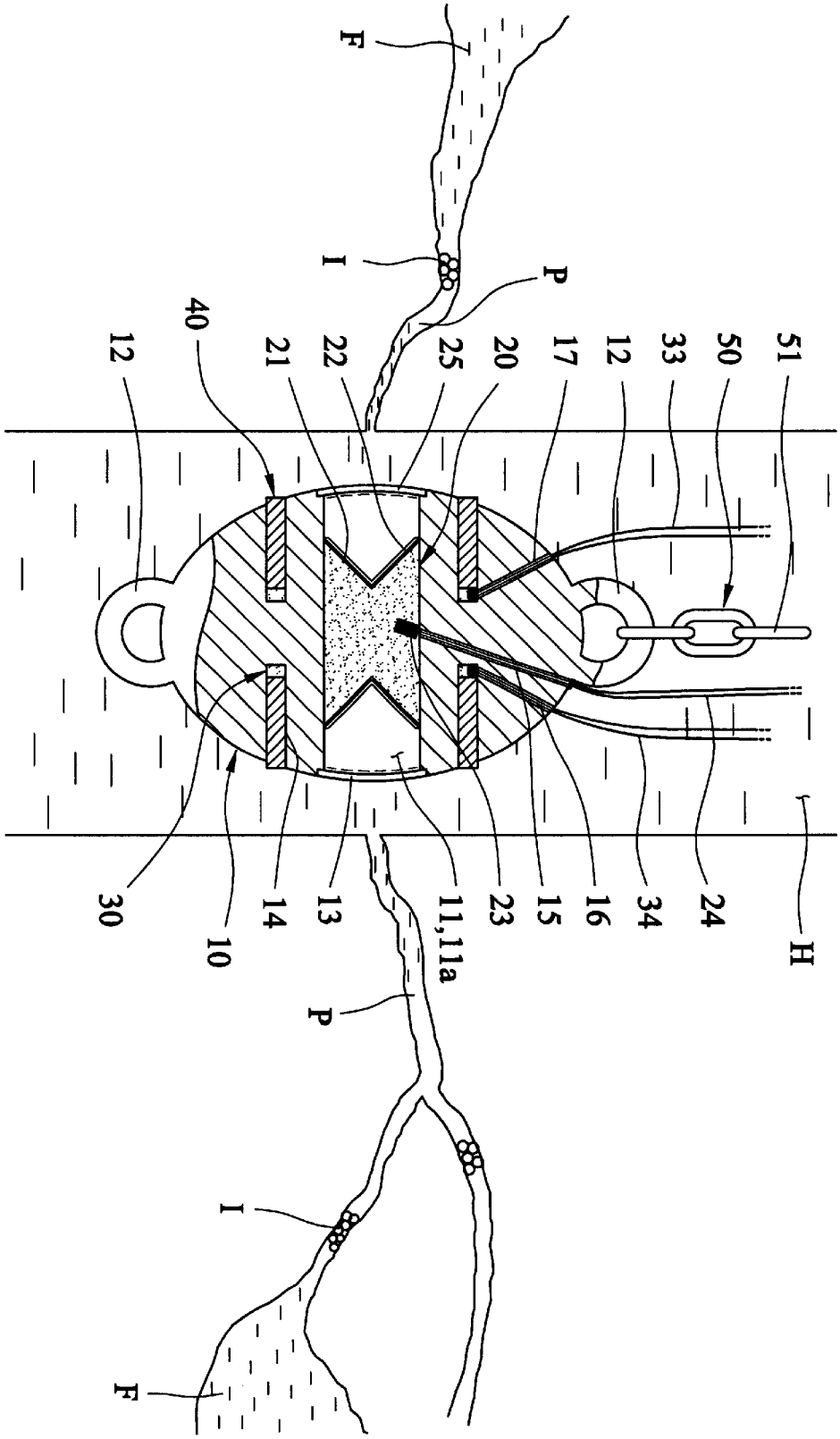
FIG. 3*b* is a view showing the blasting apparatus of the first embodiment situated in a vertical pit.

Referring to FIG. 3*b*, through holes 16 and 17 are extended from the inner portions of the two pipe-shaped gaps 14 to the upper surface of the body 10. Delayed detonators 31 and 32 and the ends of detonator leads 33 and 34 to be connected to leading wires are embedded in propulsive explosives 30 via the through holes 16 and 17.

The structure of the body 10 of FIG. 3*b* is a modification of the body 10 of the FIG. 2*b*. The structure of the body 10 of FIG. 3*b* enables a two stage explosion in which the propulsive explosives 30 are firstly detonated and the shaped explosive 20 is secondly detonated.

The propulsive explosives 30 are loaded in the inner portions of the pipe-shaped gaps 14, together with the delayed detonators 31 and 32, and firstly detonated to bring the plastic sealing pipes 40 into contact with the wall of the vertical pit H. Although the propulsive explosives 30 are formed in the shape of rings, the propulsive explosives 30 are formed in such a manner that a plurality of unit explosives are regularly spaced apart from one another and are connected by a detonating fuse.

The amount of the propulsive explosive 30 is in the range of 10 to 30 kg. The amount of the propulsive explosive 30 that can allow the sealing pipes 40 to be brought into contact with the wall of the pit H suffices, so a small amount of propulsive explosive 30 is loaded in the blasting apparatus.

Figure 3C:
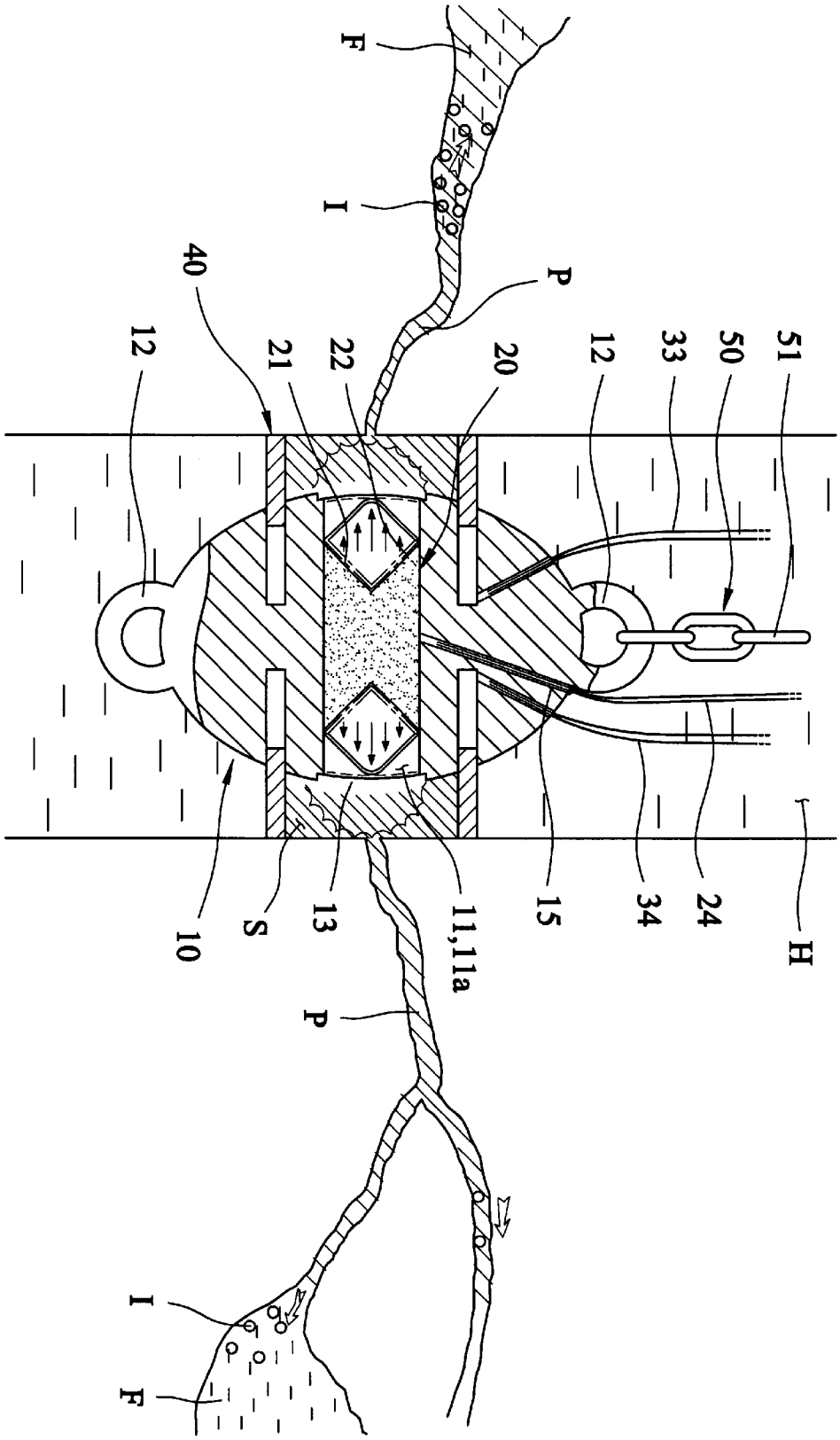
FIG. 3*c* is a view showing the operation of the blasting apparatus of the second embodiment.

As shown in FIGS. 3*b* and 3*c*, the sealing pipes 40 are fabricated of plastic and in the form of pipes, and stem the pipe-shaped gaps 14 to seal the propulsive explosives 30. The sealing pipes 40 are brought into contact with the wall of the vertical pit H by the explosion of the propulsive explosives 30, so a sealed space S is formed by separating the space between the body 10 and the wall of the pit H from the other space.

The sealing pipes 40 serve as walls for temporarily confining explosive power discharged from the discharge openings 13 in the sealed space S so as to prevent the explosive power from being discharged out of the sealed space S. Accordingly, the sealing pipes 40 allow the explosive power to be concentrated and act on the joint zone of a rock and a bedding, and perform water pressure proofing and safe explosion functions.

As shown in FIG. 3*c*, the sealing pipes 40 are formed to have an appropriate length so as to prevent the sealing pipes 40 from coming out of the pipe-shaped gaps 14 when the sealing pipes 40 are projected from the pipe-shaped gaps 14 to form the sealing space S. When explosive-power is increased to a certain extent in the sealed space S while enlarging the discharge passages after the explosion of the shaped explosive 20, the sealing pipes 40 of plastic are broken into fragments.

Figure 3D:
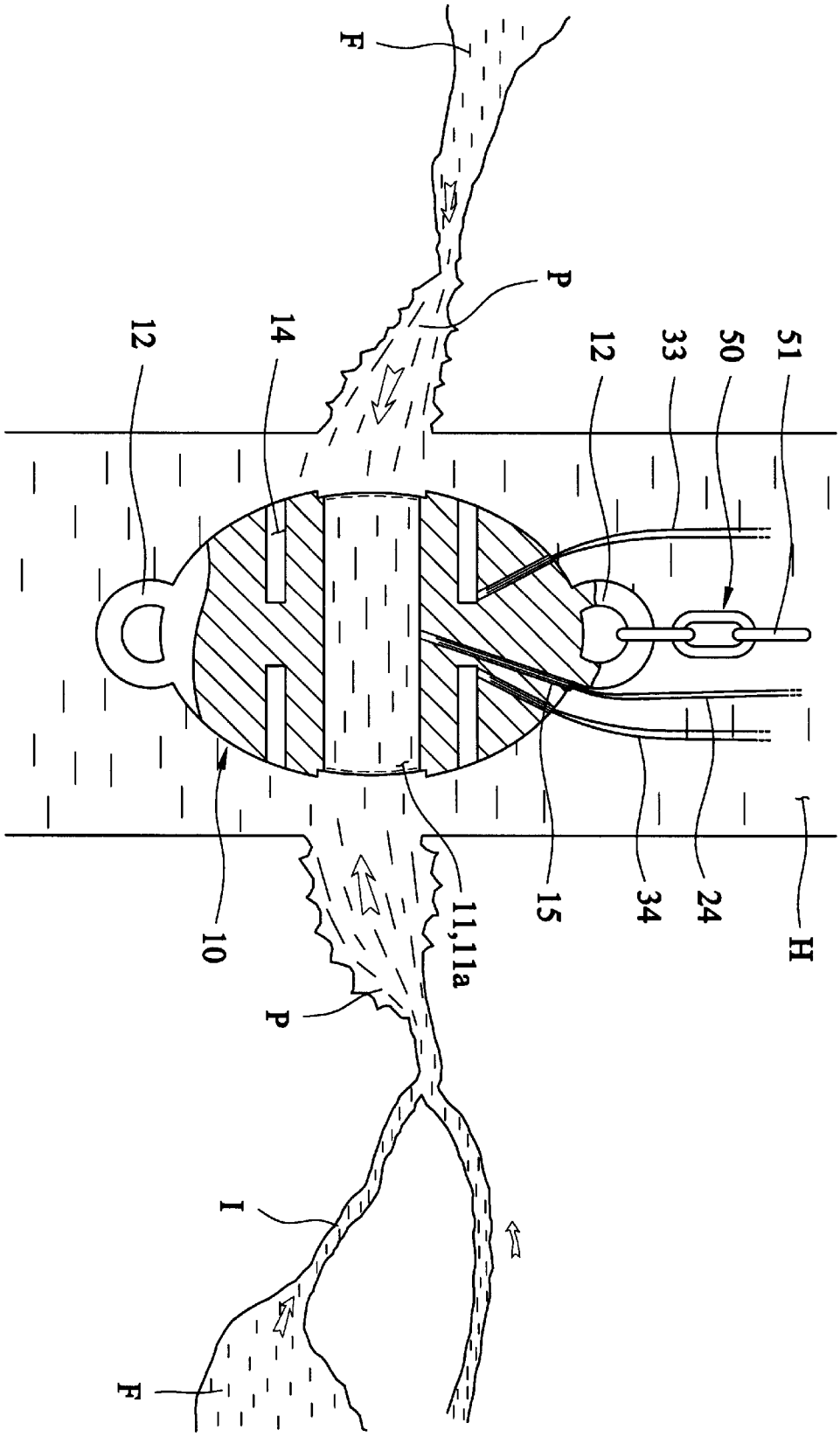
FIG. 3*d* is a view showing the further developed operation of the blasting apparatus of the second embodiment.

As depicted in FIG. 3*d*, when the explosion is completed, conical cavities are formed through the discharge openings of the wall and the discharge passages are enlarged, thereby forming horizontal cavities and allowing fluid to smoothly flow through the discharge passages.

This construction allows the shaped explosive 20 to be exploded within a sealed space, so explosive power is concentrated and continuously exerted on the discharge passages P. Accordingly, the explosive power is exerted into the discharge passages P and removes detritus I.

Figure 3E:
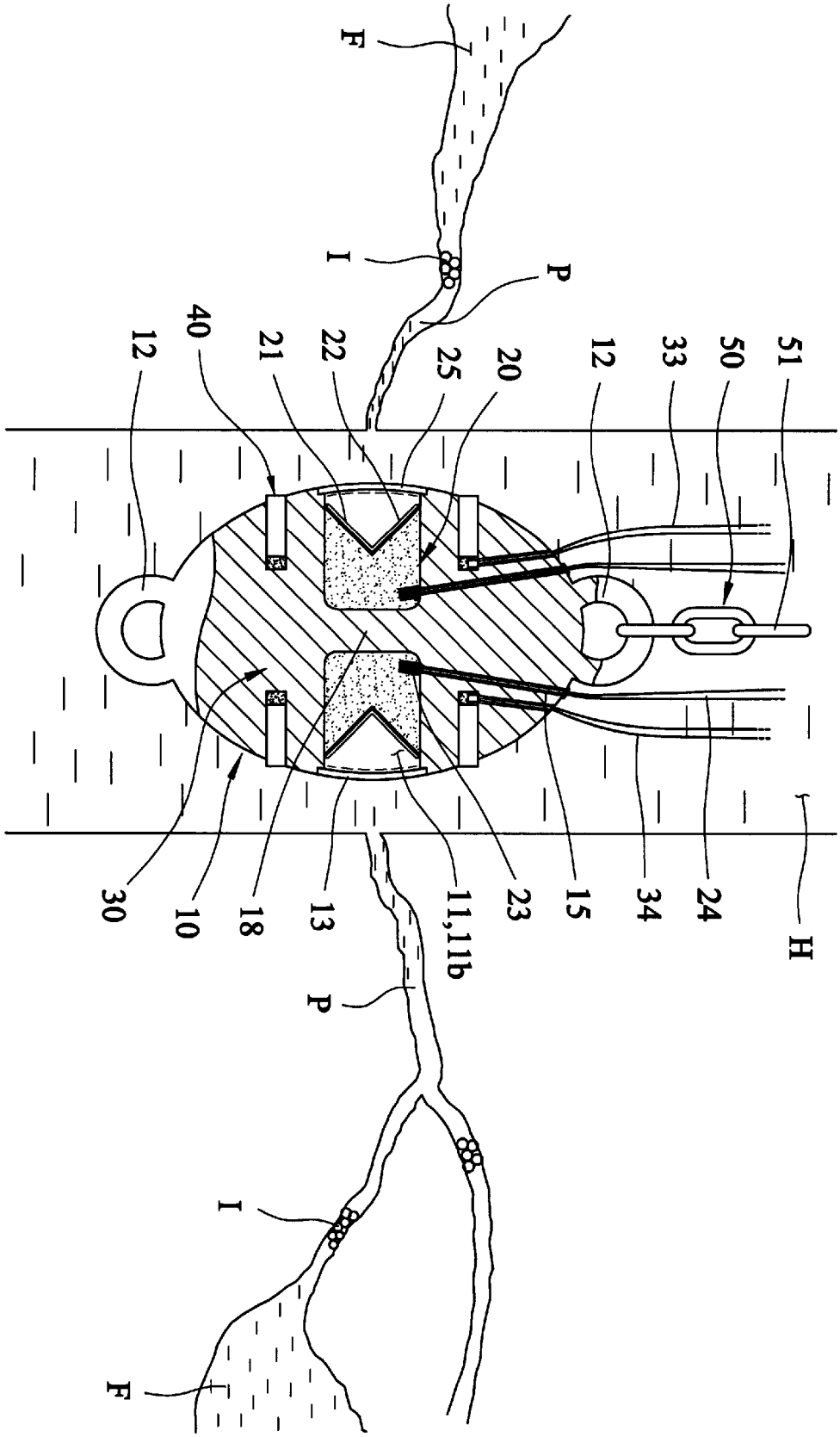
FIG. 3*e* is a view showing a modification of the blasted apparatus of the second embodiment situated in a vertical pit.

The loading chambers of FIG. 3*e* are a modification of the chamber of FIGS. 3*a*, 3*b*, 3*c* or 3*d*. A plurality of inner end-closed holes 11*b* are formed to be symmetrical with respect to the partition wall 18.

In the meantime, the connecting chain 50 connects one body 10 to another, or connects the body 50 to the hoisting rope 70 of a hoisting device $W_1$. The connecting chain 50 is comprised of a plurality of rings passing through one another. In detail, the connecting chain 50 connects the connecting ring formed on one end of one body to the connecting ring formed on one end of another, or connects the connecting ring formed on the upper end of a body 10 to the lower end of the hoisting rope 70

Meanwhile, the leading wire 60 is wound around a take-up device $W_2$, and connected to the detonator leads 24 just before the body 10 loaded with the shaped explosive 20 is inserted into the vertical pit H. The leading wire 60 is inserted into the vertical pit H together with the blasting apparatus with its part inserted into the ring 51 of the connecting chain 50. In the process of the insertion of the blasting apparatus, the leading wire 60 is unwound from the take-up device $W_2$. When the body 10 is positioned at a predetermined position in the vertical pit H, one end of the leading wire 60 wound around the take-up device $W_2$ is connected to the detonating device.

Hereinafter, a blasting apparatus for forming horizontal underground cavities in accordance with a first embodiment is described.

In this embodiment, the through hole 11*a* is formed through the center portion of the body 10, and two connecting rings 12 are formed on the upper and lower ends of the body, respectively. The shaped explosive 20 provided with the delayed detonator 23 and the metallic liners 22 is loaded in the through hole 11*a* of the body 10. The blasting apparatus is detonated with the detonator lead 24 connected to the leading wire 60 and the leading wire 60 connected to the detonating device.

One end of the detonator lead 24 is drawn into the through hole 11*a* via the through hole 15, and connected to the delayed detonator 23. The detonator lead 24 and the delayed detonator 23 are loaded in the center portion of the through hole 11*a,* together with the shaped explosive 20. The other end of the detonator lead 24 is connected to the leading wire 60. As the leading wire 60 is inserted into the vertical pit H along with the blasting apparatus, the leading wire 60 is unwound from the take-up device $W_2$. Since the other elements are the same as the elements described above, the detailed description of those is omitted.

In accordance with the present invention, the blasting apparatus creates a single stage explosion. In detail, the explosive power breaks the covers 25, and is concentrated in the direction perpendicular to the direction of the vertical pit H.

Figure 2G:
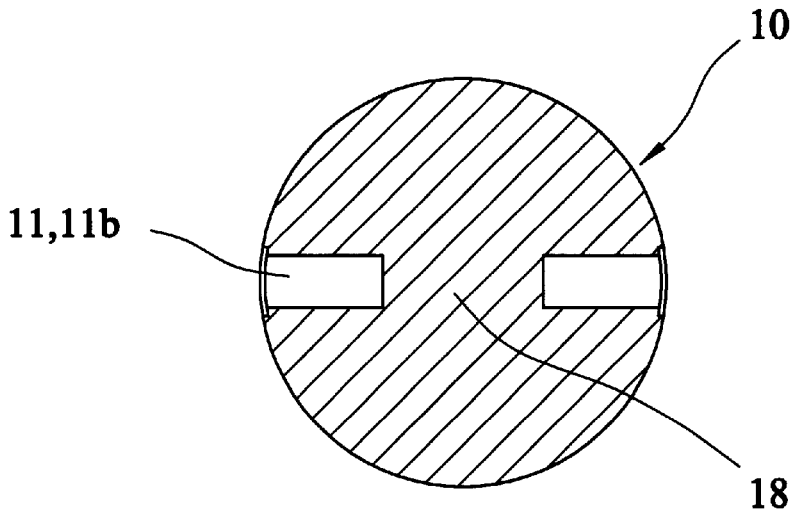
FIG. 2*g* is a horizontal cross section showing the modification of the blasted apparatus of the first embodiment.
Figure 2H:
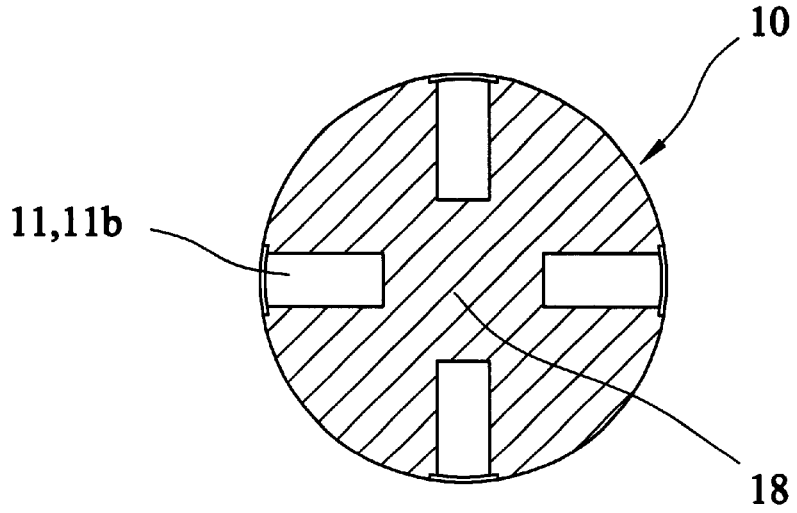
FIG. 2*h* is a horizontal cross section showing another modification of the blasted apparatus of the first embodiment.

As modifications of the first embodiment, the loading chamber can be the inner end-closed hole 11*b,* the inner end of which is closed and the outer end of which is opened as shown in FIGS. 2*e* and 2*f,* the inner end-closed holes 11*b* arranged to be symmetrical with respect to the partition wall 18 in the center of the body 10 as shown in FIGS. 2*g* and 2*h,* and inner end-closed holes 11*b* arranged radially at the intervals of 90°.

Hereinafter, a blasting apparatus for forming horizontal underground cavities in accordance with a second embodiment is described.

In this embodiment, the structure of a body 10 is somewhat modified. Differently from the first embodiment in which the loading chamber 11, or the through hole 11*a* or inner end-closed hole(s) are formed in the body 11, the pipe-shaped gaps 14 are formed in the body 10 around the through hole 11*a* to be concentric with the loading chamber 11 and to be symmetrically arranged as shown in FIG. 3*b,* and filled with the ring shaped propulsive explosives 30 provided with the delayed detonators 31 and 32 and the sealing pipes 40. The other elements are the same as those of the previous embodiments.

In the second embodiment, a two stage explosion can be achieved. As illustrated in FIG. 3*c,* the sealing pipes 40 are brought into contact with the wall of the vertical pit H by the first explosion of the propulsive explosives 30 loaded in the inner portions of the pipe-shaped gaps to form a sealed explosion space S, and, thereafter, the shaped explosive 20 loaded in the loading chamber 11 is secondly exploded.

The blasting apparatus of the second embodiment is different from the blasting apparatus of the first embodiment in that the sealing pipes 40 are brought into contact with the wall of the vertical pit H by the first explosion and, therefore, the explosive power of the shaped explosive 20 is concentrated in a horizontal direction without the loss of power due to the leakage of the explosive power. Therefore, the blasting apparatus of the second embodiment is superior in effectiveness to the blasting apparatus of the first embodiment.

In the meantime, as shown in FIG. 3*e,* the inner end-closed holes 11*b* arranged to be symmetrical with respect to the partition wall 18 can be employed as a modification of the loading chamber 11.

In the first and second embodiments, the shaped explosive 20 may be provided with the funnel-shaped metallic liners 22, so the explosive power of the shaped explosive 20 can powerfully hit the opening formed in the wall of the vertical pit H and form horizontal cavities.

Figure 4:
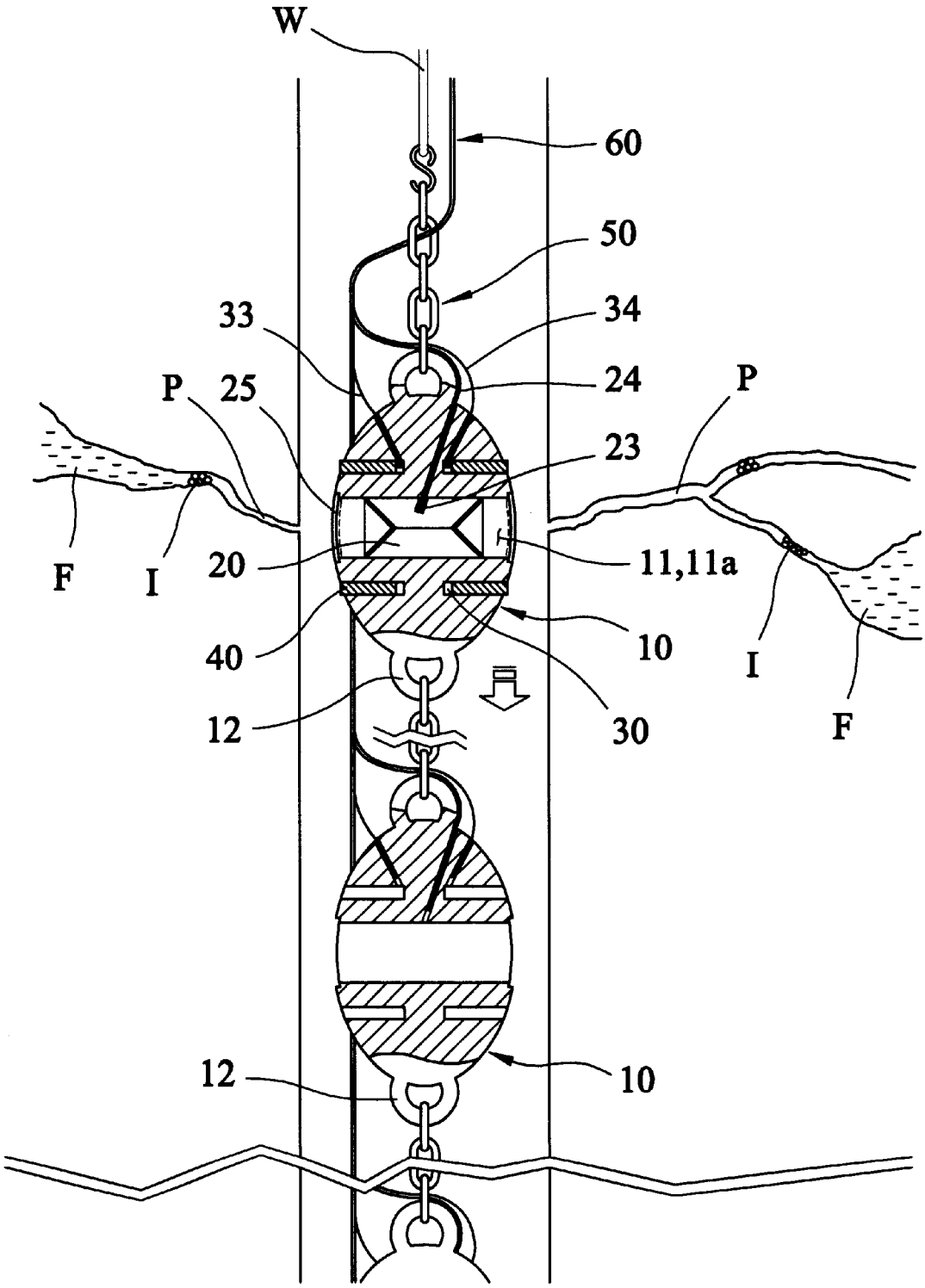
FIG. 4 is a view showing a blasting apparatus assembly in accordance with-the present invention.

Meanwhile, in another embodiment, there is provided a blasting apparatus assembly in which a plurality of blasting apparatuses are connected to one another. As shown in FIG. 4, a plurality of bodies 10 are connected to one another by connecting chains 50 so as to enable a multistage explosion. In accordance with this embodiment, the blasting apparatuses are sequentially situated at a position where horizontal cavities are desired to be formed and sequentially detonated, so blasting effect can be enhanced.

The blasting apparatus assembly in which a plurality of blasting apparatuses are connected to one another may be divided into two types.

One type relates to a third embodiment in which a plurality of blasting apparatuses connected at regular intervals to one another by the connecting chains have the loading chambers with each of the loading chambers of one blasting assembly arranged in the same direction as the corresponding loading chamber of another blasting assembly. The blasting apparatus assembly of the third embodiment is used to repeatedly blast the same position on the wall of the vertical pit H. When the position of the discharge passage of fluid is clearly known, this blasting apparatus assembly can be utilized effectively.

The other type relates to a fourth-embodiment in which a plurality of blasting apparatuses connected at regular intervals to one another by the connecting chains have the loading chambers with each of the loading chambers of one blasting apparatus arranged to be perpendicular to the corresponding loading chamber of a neighboring blasting apparatus. The blasting apparatus assembly of the fourth embodiment is used to circumferentially blast the wall of the vertical pit H. When the discharge passage of the fluid is not known clearly, this blasting apparatus assembly can be used to increase the possibility of fluid discharge.

In the third and fourth embodiments, the detonator leads 24 drawn to the outside from the delayed detonators 31 and 32 embedded in the shaped explosive 20 and the detonator leads 33 and 34 drawn from the delayed detonators 32 and 32 positioned beside the propulsive explosives 30 are connected to the leading wire 60 unwound from the take-up device $W_2$ just before each blasting apparatus is inserted into the vertical pit H. The detonator leads 24, 33 and 34 drawn from each blasting apparatus are connected to each leading wire and are inserted into the vertical pit H.

In such a case, the leading wire 60 is preferably extended through the ring 51 of the connecting chain 50 at a position that forms an angle of 90▽ with the direction of the loading chamber 11 so as to prevent the leading wire 60 from passing by the loading chamber 11.

This is to prevent a misexplosion by preventing the leading wire from being twisted or broken by the explosive power discharged from the loading chamber 11 of each blasting apparatus.

The regular interval between two neighboring blasting apparatuses is determined as at least 1 m in consideration of sympathetic detonation.

The blasting conducted by the blasting apparatuses of the present invention is directional, continuous and concentrated by the Neumann effect, so the explosive power of the shaped explosive is exerted on the restricted area of the wall of the vertical pit H. Therefore, horizontal cavities are formed underground with the breakdown and collapse of the wall of the pit H maximized, and the explosive power of the shaped explosive 24 infiltrates deep into discharge passages to remove detritus blocking the discharge passages.

In addition, bubbles caused by explosive gas projected into the discharge passages upon the explosion of the shaped explosive 20 are injected into the fluid discharge passages, and discharged from the fluid discharge passages together with fluid by the siphon effect, thereby allowing the fluid to be desirably discharged.

In the blasting apparatus assembly, a desired number (preferably, less than ten) of bodies 10 are connected to one another at regular intervals, and the blasting apparatuses are sequentially positioned and detonated. As a result, in the joint zone of a rock the possibility of opening fluid discharge passages is maximized, and the efficiency of the blasting process is improved. So, the blasting apparatus assembly can be called "a repeating underground cannon".

A blasting method for forming horizontal underground cavities using the above-described blasting apparatus and blasting apparatus assembly is described with reference to FIGS. 4 to 9, hereinafter.

Figure 5:
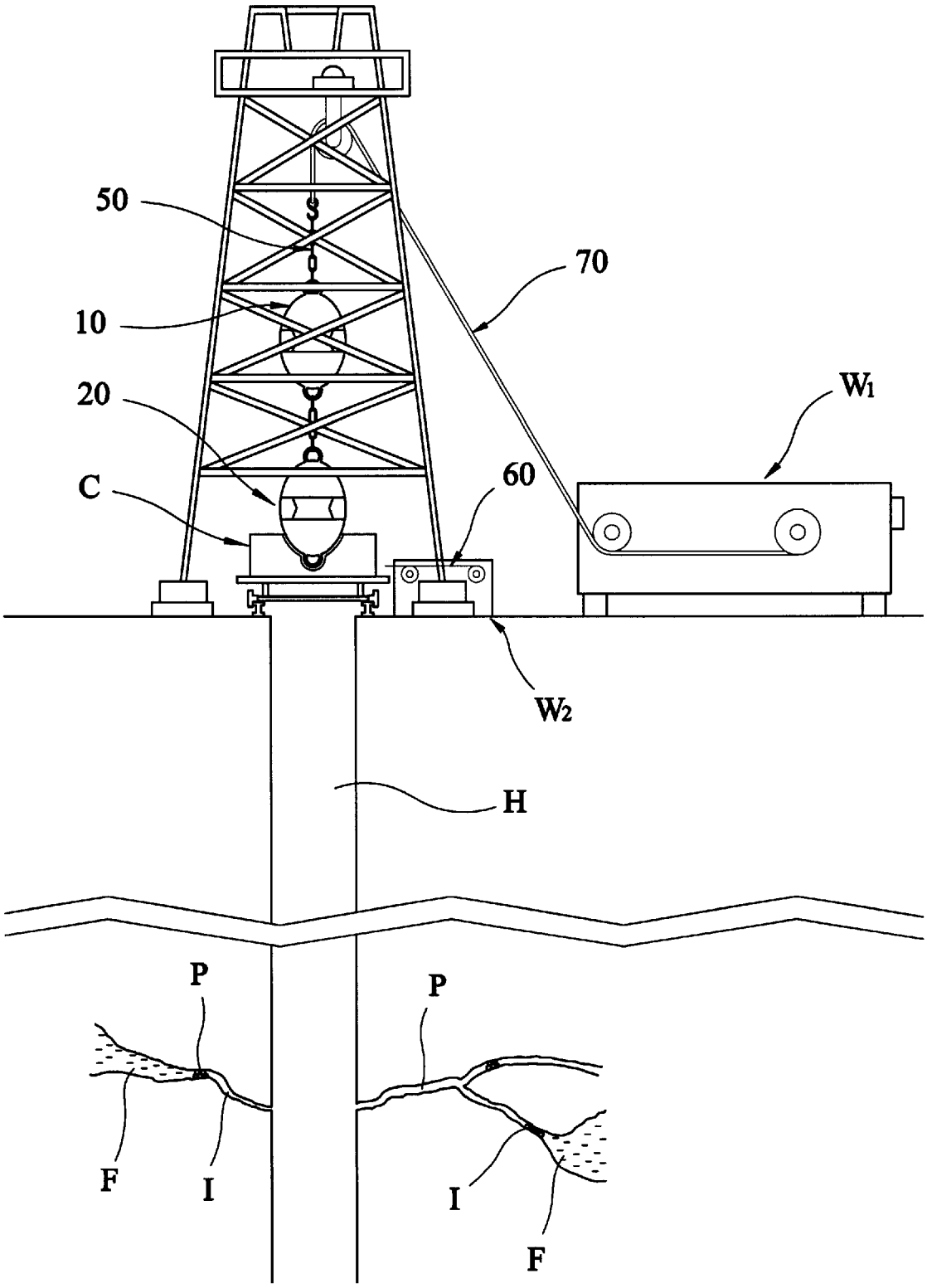
FIG. 5 is a view showing the step of suspending a blasting apparatus assembly.

As depicted in FIGS. 4 and 5, while the body 10 of the blasting apparatus having been manufactured in a factory is placed on the holder of a carrier C, the delayed detonator 23, the detonator lead 24, the shaped explosive 20 and the metallic liners 22 are loaded in the loading chamber 11 of the body 10 of the blasting apparatus.

Meanwhile, the propulsive explosives 30, the sealing pipes 40, the delayed detonators 31 and 32 and the detonator leads 33 and 34 can be loaded in the loading chamber 11 according to the structure of the body 10. In this case, the detonator leads 33 and 34 are inserted into the through holes 15 and connected to the delayed detonators 31 and 32, the detonators 31 and 32 are loaded together with the propulsive explosives 30 in the inner end portions of the pipe-shaped gaps, and the pipe-shaped gaps are stemmed by the sealing pipes 40.

The gaps between the detonator leads 24, 33 and 34 and the through holes 15, 16 and 17 are filled with sealing material to be sealed, and the covers 25 are attached to the stepped portions of the entrances of the sealing chambers 11 by a bonding agent, thereby completing a loading process.

After the explosive and the detonator are loaded in the loading chamber 11 of the body 10, the blasting apparatus is moved beside the vertical pit H by the carrier C, and suspended by connecting the upper connecting ring of the body 10 of the blasting apparatus to the connecting chain connected to he hoisting rope 70 wound around the hoisting device $W_1$.

After the first blasting apparatus is suspended, a second blasting apparatus is suspended in such a manner that a next blasting apparatus is moved beside the vertical pit H, the upper ring of a next connecting chain is connected to the lower ring of the first blasting apparatus, and the lower ring of the next chain is connected to the upper ring of the next blasting apparatus.

A plurality of blasting apparatuses are suspended over the vertical pit H by repeating the connecting and suspending processes.

Figure 6:
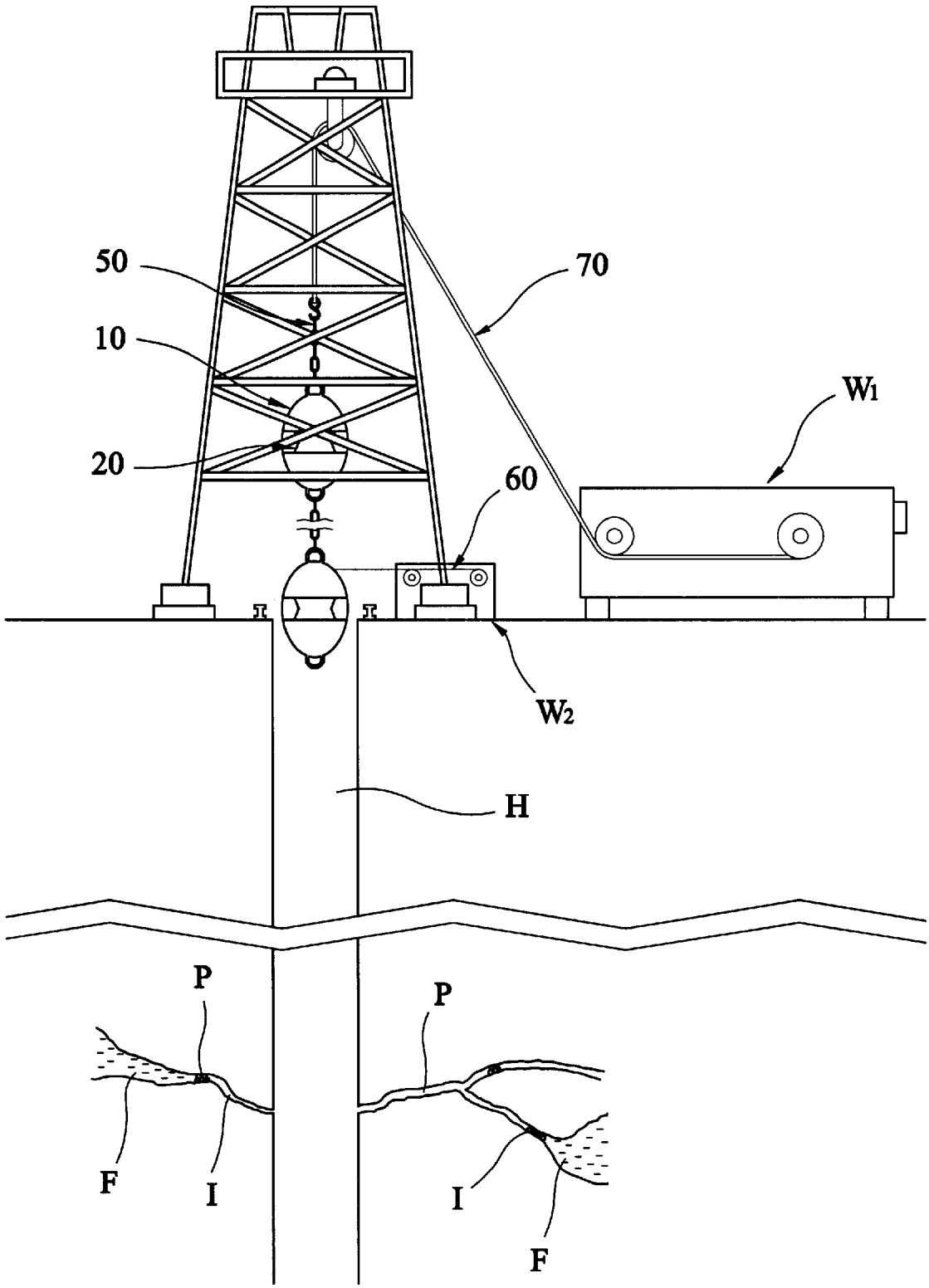
FIG. 6 is a view showing the step of connecting a detonator lead to a leading wire.
Figure 7:
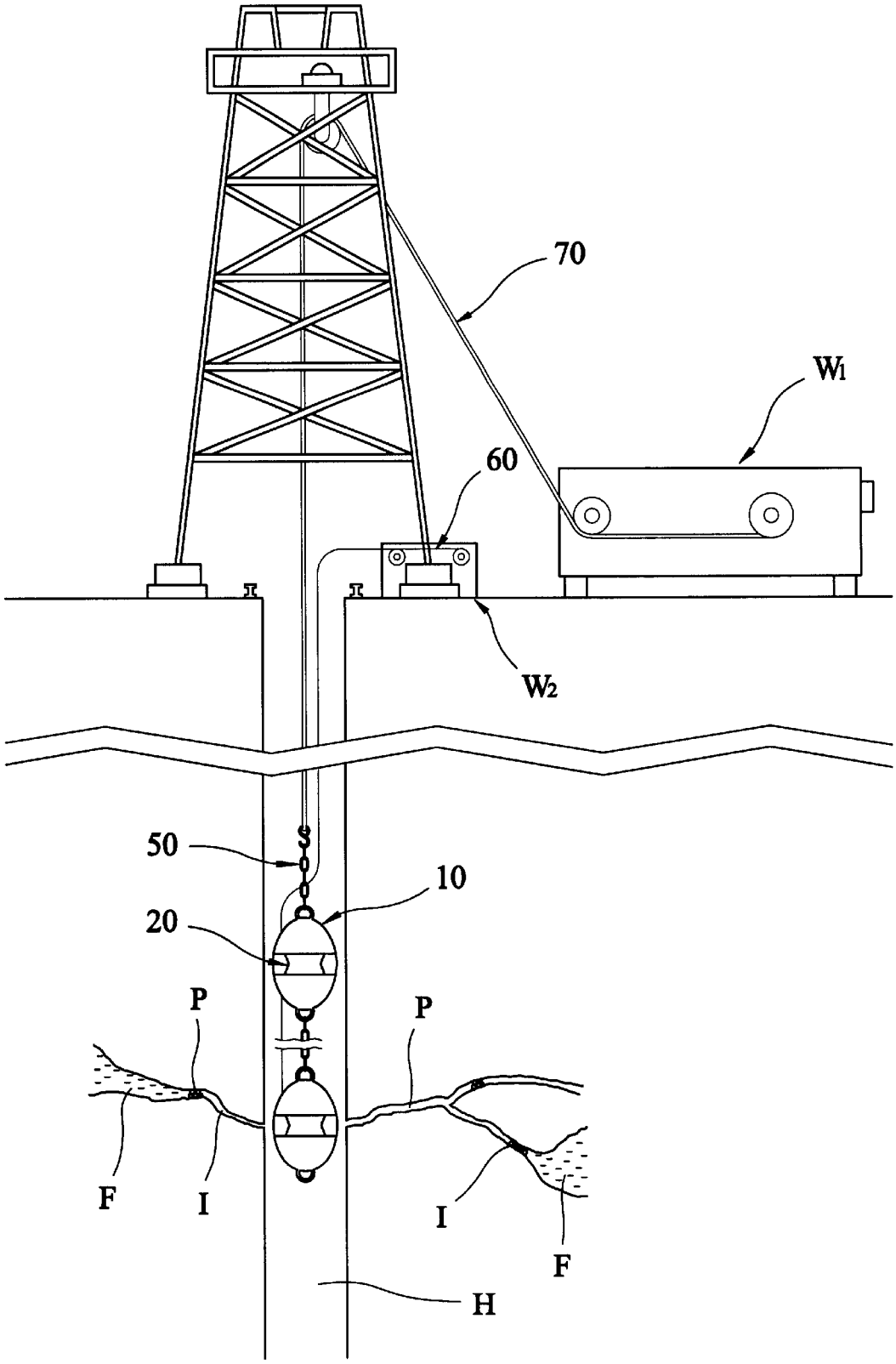
FIG. 7 is a view showing the step of inserting the blasting apparatus assembly into a vertical pit.

As shown in FIG. 6, the lowermost blasting apparatus suspended over the vertical pit H is lowered to the entrance of the vertical pit H, and the detonator leads drawn through the upper surface of the body 10 to the outside are connected to the leading wire 60, and the blasting apparatus connected to the leading wire 60 are inserted into the vertical pit H and lowered to a desired position. Thereafter, the next blasting apparatus is positioned at the entrance of the vertical pit H and the connecting process of connecting detonator leads to a leading wire and the lowering process of lowering the next blasting apparatus connected to the leading wire into the vertical pit H are repeated.

While the blasting apparatus is lowered into the vertical pit H, the leading wire 60 is unwound from the take-up device $W_2$ so as to allow the leading wire 60 to be lowered along with the body 10 of the blasting apparatus. For the blasting apparatus assembly in which a plurality of blasting apparatuses are connected to one another, each leading wire is connected to each blasting apparatus, so a plurality of leading wires are connected to the detonating device. Accordingly, the leading wires have to be arranged to be distinguishable from one another.

After the detonator leads of the blasting apparatus are connected to the leading wire, the blasting apparatus is inserted and lowered into the vertical pit H. The blasting apparatus is situated at the desired position of the vertical pit H by unwinding the hoisting rope 70 from the hoisting device $W_1$.

The leading wires 60 connected to the detonator leads 24, 33 and 34 are unwound and lowered to the positions of the lowered blasting apparatuses. When the blasting apparatuses are situated at desired positions, preparations for the blasting are completed by connecting the leading wires to the blasting device.

Figure 8:
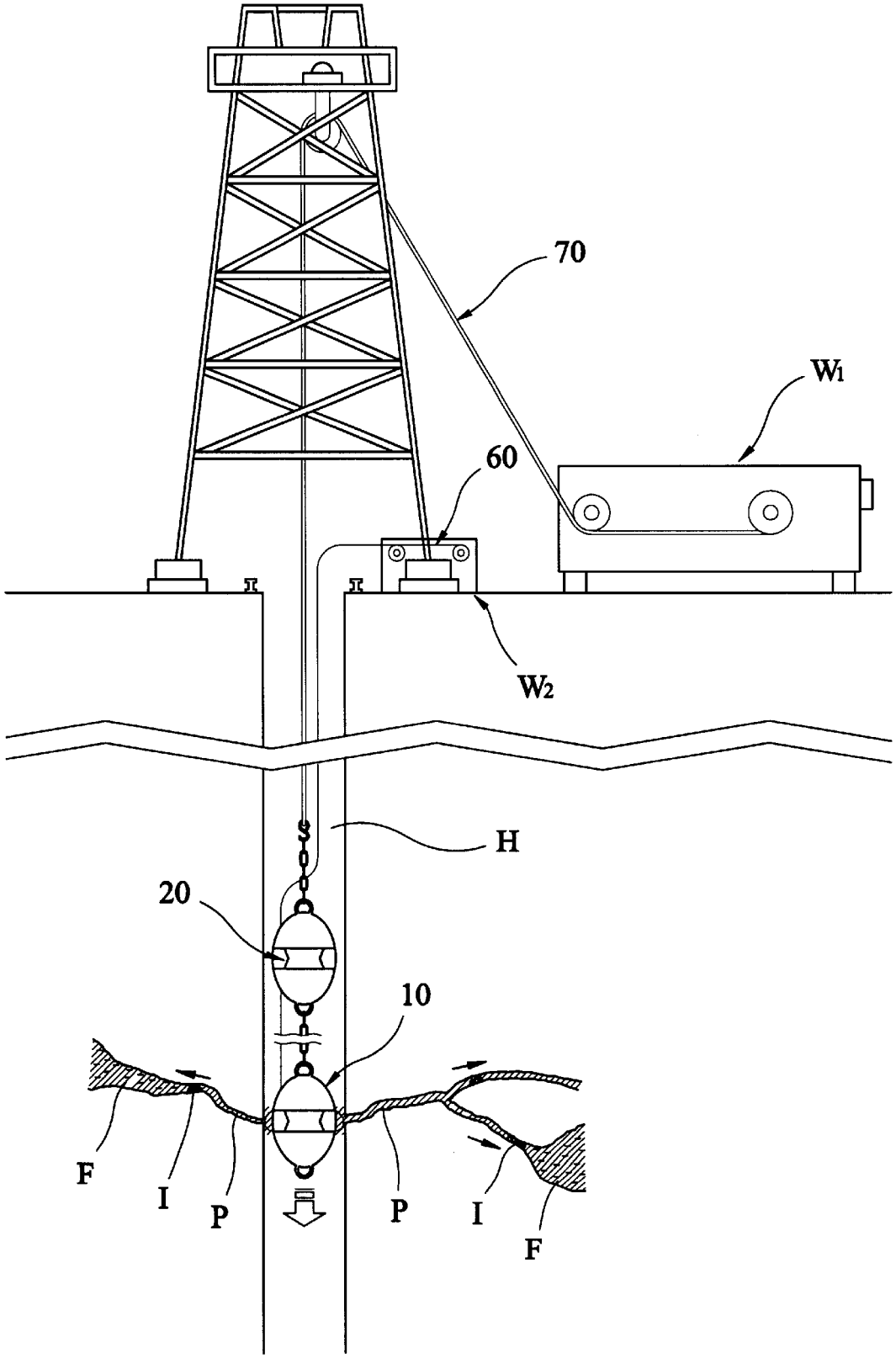
FIG. 8 is a view showing the step of exploding the blasting apparatus assembly.

The above-described step is followed by a blasting step. As shown in FIGS. 4 and 8, the shaped explosive 20 is detonated by igniting the delayed detonator by the detonating device, so the explosive power of the shaped explosive 20 is discharged in a horizontal direction. Hence, the horizontal, conical openings are formed in the wall of the vertical pit H and the fluid discharge passages are enlarged by the explosive power.

Although for the blasting apparatus of the first embodiment shown in FIG. 2*a* the shaped explosive 20 is connected to the detonating device by the detonator lead and ignited by the detonating device, the shaped explosive 20 can be detonated by igniting the delayed detonator by a remote controller.

Meanwhile, for the blasting apparatus of the second embodiment shown in FIG. 3*a,* after the sealing pipes 40 are brought into contact with the wall of the vertical pit H by firstly exploding the propulsive explosives 30 to seal an explosion space from the outside, the shaped explosive 20 is secondly exploded. Accordingly, the detonator leads are employed for this blasting apparatus, and the detonators of this blasting apparatus should be ignited by the blasting device.

In the first and second embodiments, a single blasting apparatus is exploded. When the blasting apparatus assembly is employed, the blasting apparatuses constituting the blasting apparatus assembly are sequentially lowered to the same position and explosions are repeated a plurality of times.

In the blasting apparatus assembly of the third embodiment shown in FIG. 4, each of the loading chambers 11 of the body 10 of one blasting apparatus is arranged in the same direction as the corresponding loading chamber of another blasting apparatus. This type of blasting apparatus assembly is effectively used when the position where fluid discharges or will discharge is clearly known and the explosive power of the shaped explosives is required to be concentrated on the same position by repeatedly exploding the shaped explosives at the same position.

Although not shown in the accompanying drawings, in the blasting apparatus assembly, each of the loading chambers of one blasting apparatus is arranged to be perpendicular to the corresponding loading chamber of a neighboring blasting apparatus. This type of blasting apparatus assembly can be effectively used when the position where fluid discharges or will discharge is not known and circumferential explosions are required to be carried out.

The blasting apparatus assemblies of the fourth and fifth embodiments are used in such a way that an explosion is conducted at the frequency corresponding to the number of the blasting apparatuses of the blasting apparatus assembly.

Figure 9:
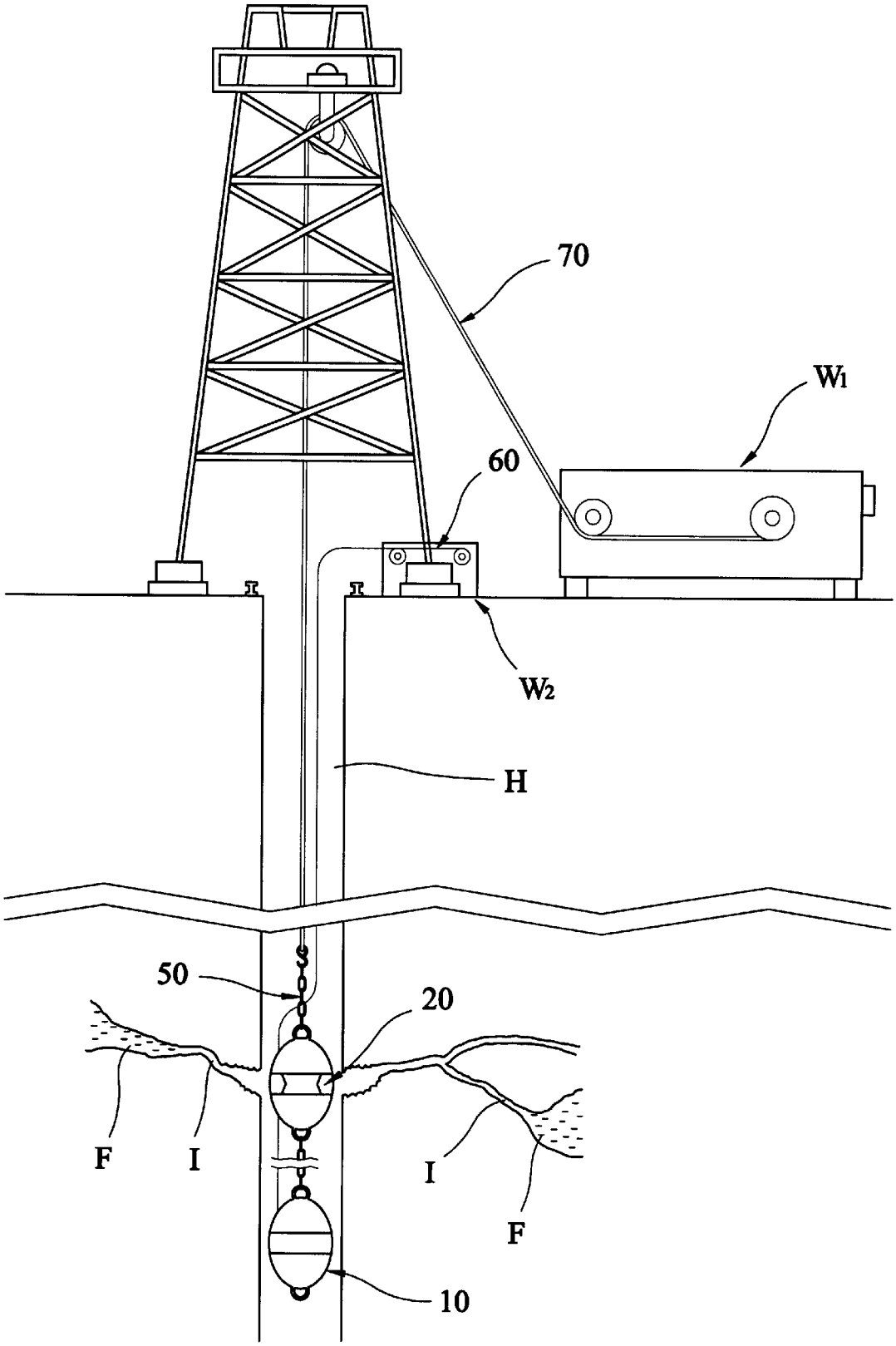
FIG. 9 is a view showing the blasted portion of the vertical pit after the blasting apparatus assembly is exploded.

As shown in FIG. 9, after the horizontal underground cavities are formed by the explosion of the blasting apparatuses, the blasting apparatuses having been suspended by the hoisting rope 70 in the vertical pit H and the leading wires 60 having been unwound from the take-up device $W_2$ and drawn into the vertical pit H are pulled out of the vertical pit H, and recycled for next blasting with a shaped explosive loaded in the loading chamber 11 of the body 10.

In the blasting method using the blasting apparatus, the blasting apparatus having the functions of the concentration of explosive power, the continuation of explosive power and the creation of siphon effect is inserted into and exploded in the vertical pit H, so the explosive power is concentrated on a restricted area. As a result, conical openings are formed in the wall of the vertical pit H, and the explosive power is exerted deep into fluid discharge passages and removes detritus in the fluid discharge passages, thereby allowing fluid to desirably discharge.

The blasting method of the present invention blasts horizontal underground cavities using directional explosive power and the concentration effect of the explosive power, that is, the Neumann effect, so a desired amount of explosive power is generated with a minimum amount of explosive, thereby precisely enlarging fluid discharge passages.

The blasting method of the present invention forms a horizontal conical openings in the wall of the vertical pit H, so the explosive power of the shaped explosive 20 is exerted on the restricted area of the wall of the vertical pit H, thereby preventing the wall of the vertical pit H from being collapsed.

Like an antitank high explosive utilizing the Neumann effect and penetrating the armor of a tank (the antitank high explosive can penetrate armor of 35 cm), the blasting apparatus of the present invention allows explosive power to penetrate deep into a rock and the joint zone of a rock, so detritus is removed from fluid discharge passages, thereby allowing fluid to be desirably discharged.

In accordance with the blasting method of the present invention, horizontal, conical cavities are formed on the restricted area of the wall of the vertical pit, so the collapse of the vertical pit is prevented. Additionally, in the blasting method of the present invention, the loss of explosive power and the damage to the vertical hole are minimized, so about the amount of an explosive corresponding to 20% of the amount of explosive typically used for the conventional method suffices.

Since the blasting apparatus is employed in the blasting method of the present invention, the loading of the explosive, the insertion of the explosive into a vertical pit, a series of explosions and the recycling of the blasting apparatus are possible, thereby improving the effectiveness of an underground cavity blasting operation.

As described above, the present invention provides the blasting apparatus for forming horizontal underground cavities and method using the same, which is capable of directing explosive power in a horizontal direction by exploding a shaped explosive in a restricted, horizontal loading chamber, so the explosive power of the shaped explosive is concentrated in the direction perpendicular to the direction of a vertical pit and the explosive power is continued, thereby forming horizontal underground cavities without the collapse of the wall of the vertical pit by exerting explosive power on the desired area of the wall of the vertical pit.

In addition, in accordance with the present invention, the maximum explosive power is continued with the minimum loading, so underground water in the vertical pit H serves as a water cannon, thereby allowing high pressure gas and high pressure water to act together. Accordingly, a great amount of explosive power is exerted deep into fluid discharge passages (for example, to the extent of tens of meters), so the discharge of fluid is well performed.

In addition, in accordance with the present invention, in the case where the amount of fluid is reduced or a fluid discharge passage is blocked while fluid is mined from an underground water pit, a hot spring pit, a natural gas pit or a petroleum pit, the fluid discharge passage can be enlarged or the blocked fluid discharge passage can be opened without a new pit drilling operation, thereby regenerating the existing pit. Accordingly, the costs of a new pit drilling operation and the costs of the removal and reinstallation of facilities can be saved, thereby improving the economic efficiency of an underground cavity blasting operation.

In addition, in accordance with the present invention, when an underground water pit, a hot spring pit, a natural gas pit or a petroleum pit is developed, the generation of the directional explosive power, repeated explosions and circumferential explosions are possible, so the probability of success of a pit drilling operation is maximized.

The blasting apparatus of the present invention is made of metallic material having high strength, so its body can be recycled. The blasting apparatus allows loading to be rapidly conducted, and explosions to be performed a plurality of times, so the efficiency of a blasting operation can be improved. Additionally, the blasting apparatus can prevent a misexplosion due to water pressure. The blasting apparatus can be handled safely, so the safety of an underground cavity blasting operation is improved.

In addition, the present invention is environment-friendly technology. In detail, in accordance with the present invention, there can be prevented excessive pit drilling operations that are carried out to mine underground water, petroleum or gas, so underground pollution can be prevented, thereby contributing to environmental conservation.

As described above, the present invention provides a blasting apparatus for forming horizontal underground cavities and blasting method using the same, which is capable of creating directional, continuous and concentrated explosive power, so horizontal conical openings are formed in the wall of the vertical pit, fluid discharge passages are enlarged, explosions can be conducted many times and the blasting apparatus can be recycled, thereby improving the technological and economic efficiencies of an underground cavity blasting operation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A blasting apparatus for forming horizontal underground cavities, comprising:

a metallic body having a horizontally oriented loading chamber comprising a through bole formed through a center portion of the body;

a delayed detonator and a shaped explosive loaded in the loading chamber of the body; and a connecting ring formed on the body for connecting the body to a hoisting rope.

2. The blasting apparatus according to claim 1, further comprising:

two pipe-shaped gaps formed in the body around the loading chamber, said two pipe-shaped gaps being coaxial with the loading chamber and each having a diameter larger than that of the loading chamber;

two delayed detonators and two propulsive explosives loaded in the pipe-shaped gaps; and two plastic sealing pipes for stopping up the pipe-shaped gaps after the delayed detonators and the propulsive explosives are loaded in the pipe-shaped gaps.

3. The blasting apparatus according to claim 1, wherein said body is formed in the shape of an egg so as to reduce friction between the body and fluid filling a vertical pit while the body is lowered through the vertical pit.

4. The blasting apparatus according to claim 1, wherein said body has a width in the range of 80 to 90% of a diameter of the vertical pit.

5. The blasting apparatus according to claim 1, further comprising a through hole for a detonator lead, said through hole being extended from an upper surface of the body to a center portion of the loading chamber.

6. The blasting apparatus according to claim 2, further comprising one or more through holes for one or more detonator leads, said through holes being extended from an upper surface of the body to a center portion of the pipe-shaped gaps.

7. The blasting apparatus according to claim 1, wherein said body has a weight in the range of 50 to 500 kg.

8. The blasting apparatus according to claim 1, wherein said shaped explosive is provided at both ends with cone-shaped recesses.

9. The blasting apparatus according to claim 1, further comprising two funnel-shaped lines, said liners being attached to the cone-shaped recesses, respectively.

10. The blasting apparatus according to claim 1, wherein said shaped explosive has the amount of loading in the range of 0.1 to 1 kg.

11. The blasting apparatus according to claim 1, further comprising two covers, said covers being attached to stepped portions of entrances of the loading chamber loaded with the shaped explosive.

12. The blasting apparatus according to claim 1, wherein said connecting chain comprises a plurality of rings to prevent the connecting chain from being twisted.

13. A blasting apparatus assembly for forming horizontal cavities, comprising:

a plurality of metallic bodies each horizontally provided with a loading chamber comprising a through hole;

a plurality of delayed detonators and a plurality of explosives loaded in loading chambers of the bodies; and a plurality of connecting chains each connecting one body to another.

14. The blasting apparatus assembly according to claim 13, said blasting apparatus each further comprising:

two pipe-shaped gaps formed in the body around the loading chamber, said two pipe-shaped gaps being coaxial with the loading chamber and each having a diameter larger than the loading chamber;

two delayed detonators and two propulsive explosives loaded in the pipe-shaped gaps; and two plastic sealing pipes for stopping up the pipe-shaped gaps after the delayed detonators and the propulsive explosives are loaded in the pipe-shaped gaps.

15. The blasting apparatus assembly according to claim 13, wherein said blasting apparatuses connected to one another by the connecting chains have the loading chambers with each of loading chambers of one blasting assembly arranged in the same direction as a corresponding loading chamber of another blasting assembly.

16. The blasting apparatus assembly according to claim 13, wherein said blasting apparatuses connected to one another by the connecting chains have the loading chambers with each of loading chambers of one blasting apparatus arranged to be perpendicular to a corresponding loading chamber of a neighboring blasting apparatus.

17. A blasting method for forming horizontal cavities, comprising the steps of:

loading a detonator lead, a delayed detonator and a shaped explosive in a loading chamber horizontally formed through a center portion of a body of each of one or more blasting apparatuses;

suspending the blasting apparatuses over a vertical pit by operating a hoisting device after the blasting apparatuses are connected to a hoisting rope by a connecting chain;

lowering the blasting apparatuses suspended by the hoisting rope to an entrance of a vertical pit, and connecting detonator leads drawn out of the bodies to a leading wire wound around a take-up device positioned on a support surface just before the blasting apparatuses enter the vertical pit;

lowering the blasting apparatuses and the leading wire connected to the detonator leads drawn out of the bodies into the vertical pit at a position where fluid discharges or will discharge;

detonating the shaped explosives loaded in the blasting apparatuses positioned at the position where fluid discharges or will discharge; and retrieving the bodies of the blasting apparatuses by lifting the bodies using the hoisting device.

18. The method according to claim 17, wherein said explosive detonating step comprises the steps of:

firstly detonating delayed detonators and propulsive explosives loaded in two pipe-shaped gaps, which are coaxial with the loading chamber and have a diameter larger than the loading chamber, so as to bring two sealing pipes into contact with a wall of the vertical pit and seal a detonating space from the outside; and secondly detonating the shaped explosive loaded in the loading chamber.

19. The method according to claim 17, wherein in said explosive detonating step, a plurality of blasting apparatuses are connected to each other by connecting chains at regular intervals and installed in the ground so that directions of the loading chambers of the bodies of the blasting apparatuses are alternated by right angles, wherein each of said blasting apparatuses are exploded while being lowered in stages.

20. The method according to claim 18, wherein in said explosive detonating step, a plurality of blasting apparatuses are connected to each other by connecting chains at regular intervals and installed in the ground so that directions of the loading chambers of the bodies of the blasting apparatuses arc alternated by right angles, wherein each of said blasting apparatuses are exploded while being lowered in stages.

21. The method according to claim 17, wherein said detonating step is performed by a remote controller.

22. The method according to claim 17, wherein in said explosive detonating step, a plurality of blasting apparatuses are connected to each other by connecting chains at regular intervals and installed in the ground so that the loading chambers of the bodies of the blasting apparatuses are oriented in the same direction, and each of said blasting apparatuses are exploded at a certain position while being lowered in stages, thus concentrating blasting power onto an opening formed in the vertical pit.

23. The method according to claim 18, wherein in said explosive detonating step, a plurality of blasting apparatuses are connected to each other by connecting chains at regular intervals and installed in the ground so that the loading chambers of the bodies of the blasting apparatuses are oriented in the same direction, and each of said blasting apparatuses are exploded at a certain position while being lowered in stages, thus concentrating blasting power onto an opening formed in the vertical pit.

* * * * *